US009230475B2

(12) United States Patent
Yamamoto et al.

(10) Patent No.: US 9,230,475 B2
(45) Date of Patent: Jan. 5, 2016

(54) DISPLAY DEVICE AND ELECTRONIC APPARATUS

(71) Applicant: JOLED Inc., Tokyo (JP)

(72) Inventors: Tetsuro Yamamoto, Kanagawa (JP); Katsuhide Uchino, Kanagawa (JP)

(73) Assignee: JOLED Inc., Tokyo (JP)

( * ) Notice: Subject to any disclaimer, the term of this patent is extended or adjusted under 35 U.S.C. 154(b) by 0 days.

(21) Appl. No.: 13/969,117

(22) Filed: Aug. 16, 2013

(65) Prior Publication Data

US 2014/0062844 A1 Mar. 6, 2014

(30) Foreign Application Priority Data

Aug. 31, 2012 (JP) ..... 2012-191640

(51) Int. Cl.
*G09G 3/32* (2006.01)

(52) U.S. Cl.
CPC ..... *G09G 3/3225* (2013.01); *G09G 3/3233* (2013.01); *G09G 2300/0417* (2013.01); *G09G 2300/0842* (2013.01); *G09G 2300/0866* (2013.01); *G09G 2310/0251* (2013.01); *G09G 2320/045* (2013.01)

(58) Field of Classification Search
CPC ..... G09G 3/3233; G09G 3/3291; G09G 2320/043; G09G 2320/02; G09G 2320/0233; G09G 2320/0238; G09G 2300/0809; G09G 2300/0819; G09G 2300/0417; G09G 2300/0439; G09G 2300/0842; G09G 2300/0814; G09G 2300/0861; H01L 27/3246; H01L 27/3272; H01L 27/1214; H01L 27/12; H01L 27/3244; H01L 27/13; H01L 27/3262; H01L 51/5284; H01L 2924/0002; H01L 2924/00; H01L 29/7869; H01L 21/823412; H01L 33/025

See application file for complete search history.

(56) References Cited

U.S. PATENT DOCUMENTS

2006/0267885 A1* 11/2006 Kwak et al. ..... 345/76
2007/0126665 A1* 6/2007 Kimura ..... 345/76
2011/0181561 A1* 7/2011 Smith ..... 345/204

FOREIGN PATENT DOCUMENTS

JP 2007-310311 A 11/2007
JP 2007310311 A * 11/2007

* cited by examiner

*Primary Examiner* — Nalini Mummalaneni
(74) *Attorney, Agent, or Firm* — Michael Best & Friedrich LLP

(57) ABSTRACT

There is provided a display device including pixel circuits which are arranged and each of which includes a driving transistor to drive an electro-optical element and a capacitor connected between a gate electrode and one source/drain electrode of the driving transistor. The driving transistor is configured by stacking the gate electrode and the source/drain electrode and a peripheral portion of the gate electrode is covered by the source/drain electrode.

20 Claims, 20 Drawing Sheets

ENTIRE GATE-SOURCE CAPACITY VALUE OF DRIVING TRANSISTOR 22: $C_S$

CAPACITY VALUE OF ENTIRE CAPACITORS CONNECTED TO GATE OF DRIVING TRANSISTOR 22: $C_{all}$ BOOTSTRAP GAIN: $G = C_S / C_{all}$

DISPLAY DEVICE AND ELECTRONIC APPARATUS

BACKGROUND

The present disclosure relates to a display device and an electronic apparatus and more particularly, to a flat panel display device configured by arranging pixels each including an electro-optical element in a matrix and an electronic apparatus including the display device.

As an example of the flat panel display device, a display device that uses a so-called current driving type electro-optical element of which light emission bright changes according to a value of a current flowing to a device as a light emitting unit (light emitting element) of a pixel has been known. As an example of the current driving type electro-optical element, an organic EL (electro luminescence) element that uses electro luminescence of an organic material and uses light emission when an electric field is applied to an organic thin film has been known.

The flat panel display device that is represented by an organic EL display device has a configuration in which pixels (pixel circuits) each of which has at least a write transistor, a capacitor, and a driving transistor in addition to the electro-optical element are two-dimensionally arranged in a matrix (for example, Japanese Patent Application Laid-Open (JP-A) No. 2007-310311).

The write transistor samples a signal voltage of a video signal supplied through a signal line and writes the signal voltage to the pixel. The capacitor is connected between a gate electrode and one source/drain electrode of the driving transistor and retains the signal voltage written by the write transistor. The driving transistor drives the electro-optical element according to the signal voltage retained by the capacity element.

In the pixel circuit, the capacitor is connected between the gate electrode and one source/drain electrode of the driving transistor, so that a bootstrap operation in which a potential of the gate electrode changes according to a potential of one source/drain electrode is performed. In the bootstrap operation, a ratio of a change amount of the potential of the gate electrode with respect to a change amount of the potential of one source/drain electrode of the driving transistor becomes bootstrap gain.

SUMMARY

Here, the case in which a pixel transistor such as the driving transistor or the write transistor is formed over a semiconductor such as silicon, not an insulator such as a glass substrate, is considered. When the driving transistor is formed over the semiconductor, the bootstrap gain tends to decrease (which will be described in detail below), as compared with when the driving transistor is formed over the insulator.

If the bootstrap gain decreases, it becomes difficult to normally perform an operation of the pixel circuit, which results in deteriorating an image quality of a display image. The decrease in the bootstrap gain is generated equally in the case in which the driving transistor is formed over the insulator formed over the semiconductor such as a metal as well as the case in which the driving transistor is formed over the semiconductor.

It is desirable to provide a display device having a pixel structure that can decrease an image quality defect occurring due to a decrease in bootstrap gain, by devising a structure of a driving transistor, and an electronic apparatus including the display device.

According to an embodiment of the present disclosure, there is provided a display device including pixel circuits which are arranged and each of which includes a driving transistor to drive an electro-optical element and a capacitor connected between a gate electrode and one source/drain electrode of the driving transistor. The driving transistor is configured by stacking the gate electrode and the source/drain electrode and a peripheral portion of the gate electrode is covered by the source/drain electrode.

The display device according to an embodiment of the present disclosure can be used as a display unit in each of various electronic apparatuses including the display unit.

In the display device having the above configuration or the electronic apparatus including the display device, the peripheral portion of the gate electrode of the driving transistor is covered by the source/drain electrode, so that a parasitic capacitor is not generated between the gate electrode of the driving transistor and a metal of other layer. Instead, a parasitic capacitor is generated between the source/drain electrode of the driving transistor and the metal of other layer.

In this case, bootstrap gain is determined by a capacity value of the capacitor and capacity values of parasitic capacitors attached to the gate electrode of the driving transistor. The parasitic capacitor is not generated between the gate electrode of the driving transistor and the metal of other layer, so that the capacity values of the parasitic capacitors attached to the gate electrode decrease. Therefore, the bootstrap gain can be increased.

According to the embodiments of the present disclosure described above, because bootstrap gain can be increased by devising a structure of a driving transistor, an image quality defect occurring due to a decrease in the bootstrap gain can be decreased.

DETAILED DESCRIPTION OF THE EMBODIMENT(S)

Figure 1:
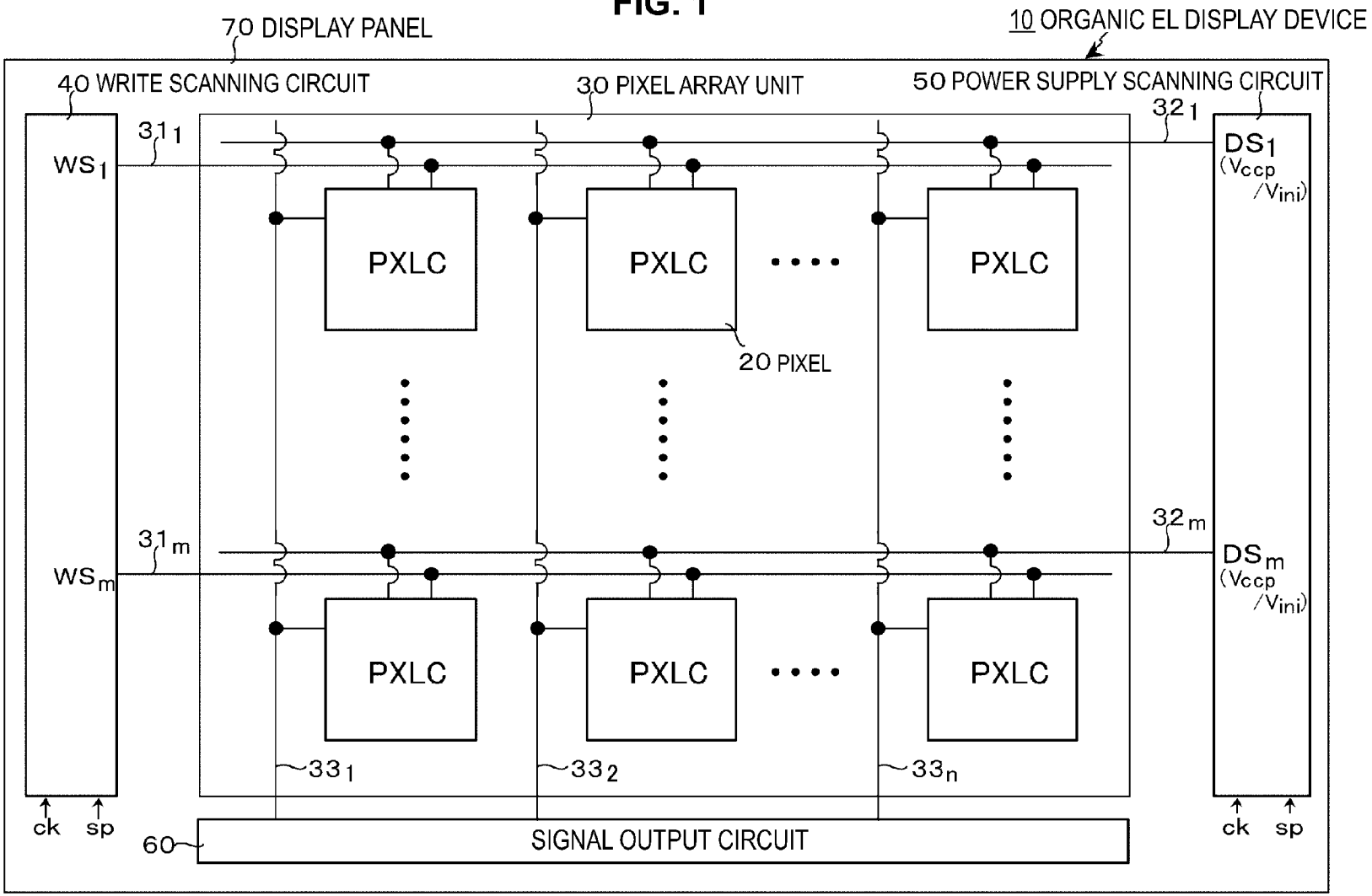
FIG. 1 is a system configuration diagram schematically illustrating a basic configuration of an active matrix type display device to which the present disclosure is applied.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

The following description will be made in the order described below.

1. Display Device and Electronic Apparatus according to Present Disclosure
2. Active Matrix Type Display Device to which Present Disclosure is applied
   2-1. System Configuration
   2-2. Pixel Circuit
   2-3. Basic Circuit Operation
   2-4. Case in which TFT is formed over Semiconductor
3. Embodiment
4. Modification
5. Electronic Apparatus
6. Configuration of Present Disclosure <1. Display Device and Electronic Apparatus According to Present Disclosure>

A display device according to an embodiment of the present disclosure is a flat panel display device configured by arranging pixel circuits each of which has an electro-optical element, a driving transistor to drive the electro-optical element, and a capacitor connected between a gate electrode and one source/drain electrode of the driving transistor.

As the flat panel display device, an organic EL display device, a liquid crystal display device, and a plasma display device can be exemplified. Among these display devices, the organic EL display device uses electro luminescence of an organic material and uses an organic EL element using light emission when an electric field is applied to an organic thin film as a light emitting element (electro-optical element) of a pixel.

The organic EL display device that uses the organic EL element as a light emitting unit of the pixel has the following features. That is, because the organic EL element can be driven with an application voltage of 10 V or less, consumption power of the organic EL display device is low. Because the organic EL element is a self-emission element, the organic EL display device has the following advantages, as compared with the liquid crystal display device to be the same flat panel display device. That is, in the organic EL display device, visibility of an image is high and it is not necessary to provide an illumination member such as a backlight. Therefore, weight and thickness can be easily decreased in the organic EL display device. Further, because the organic EL element has a very high operation speed of about several μsec, a residual image when a moving image is displayed is not generated in the organic EL display device.

The organic EL element is a current driving type electro-optical element. As the current driving type electro-optical element, in addition to the organic EL element, an inorganic EL element, an LED element, and a semiconductor laser element can be exemplified.

The flat panel display device such as the organic EL display device can be used as a display unit (display device) in various electronic apparatuses including the display unit. As the various electronic apparatuses, a portable information apparatus such as a digital camera., a video camera, a game machine, a notebook computer, or an electronic book reader and a portable communication apparatus such as a personal digital assistant (PDA) or a mobile phone can be exemplified.

In the display device that has the pixel circuits with the configuration described above, the driving transistor has a structure in which a gate electrode and a source/drain electrode are stacked and the source/drain electrode covers a peripheral portion of the gate electrode of the driving transistor.

In the display device and the electronic apparatus according to an embodiment of the present disclosure that have the preferred configuration described above, the driving transistor can have a structure in which the source/drain electrode covers a peripheral portion of a channel formation layer.

In the display device and the electronic apparatus according to an embodiment of the present disclosure that have the preferred configuration described above, the driving transistor can be formed over a semiconductor such as silicon. When a transistor is formed over the semiconductor, the transistor becomes a four-terminal element of a gate terminal, a source terminal, a drain terminal, and a back gate (base) terminal. When the driving transistor is formed over the semiconductor, bootstrap gain tends to decrease, as compared with when the driving transistor is formed over an insulator.

In the display device and the electronic apparatus according to an embodiment of the present disclosure that have the preferred configuration described above, the driving transistor can be formed over the insulator formed over a conductor such as a metal. When the transistor is formed over the insulator formed over the conductor, the transistor becomes a three-terminal element of the gate terminal, the source terminal, and the drain terminal, not the four-terminal element.

Even when the driving transistor is formed over the insulator formed over the conductor, similar to when the driving transistor is formed over the semiconductor, the bootstrap gain tends to decrease, as compared with when the driving transistor is formed over the insulator. This is because an entire portion between a semiconductor substrate and the gate electrode may become a parasitic capacitor, when a transistor having a bottom gate structure is formed over the semiconductor substrate with the insulator therebetween.

In the display device and the electronic apparatus according to an embodiment of the present disclosure that have the preferred configuration described above, the pixel circuit can have a structure in which writing of a video signal and correction of mobility of the driving transistor are performed while a current is made to flow to the driving transistor. At this time, the correction of the mobility of the driving transistor can be performed by applying negative feedback to a potential difference between the gate and the source of the driving transistor, with a correction amount according to the current flowing to the driving transistor.

<2. Active Matrix Type Display Device to Which Present Disclosure is Applied>

[2-1. System Configuration]

FIG. 1 is a system configuration diagram schematically illustrating a basic configuration of an active matrix type display device to which the present disclosure is applied.

The active matrix type display device is a display device in which a current flowing to the electro-optical element is controlled by an active element provided in the same pixel as the electro-optical element, for example, an insulating gate type field effect transistor. As the insulating gate type field effect transistor, a thin film transistor (TFT) is typically used.

Here, an example of the case of an active matrix type organic EL display device in which an organic EL element to be a current driving type electro-optical element of which light emission brightness changes according to a value of a current flowing to a device is used as a light emitting element of a pixel (pixel circuit) will be described.

As illustrated in FIG. 1, an organic EL display device 10 that becomes the premise of an embodiment of the present disclosure includes a pixel array unit 30 configured by two-dimensionally arranging a plurality of pixels 20 each having an organic EL element in a matrix and a driving circuit unit (driving unit) arranged in a peripheral portion of the pixel array unit 30. The driving circuit unit includes a write scanning circuit 40, a power supply scanning circuit 50, and a signal output circuit 60 and drives each pixel 20 of the pixel array unit 30.

Here, when the organic EL display device 10 corresponds to color display, one pixel (unit pixel) becoming a formation unit of a color image includes a plurality of sub-pixels and each of the sub-pixels corresponds to the pixel 20 illustrated in FIG. 1. Specifically, in the display device that corresponds to the color display, one pixel includes three sub-pixels of a sub-pixel to emit red (R) light, a sub-pixel to emit green (G) light, and a sub-pixel to emit blue (B) light.

However, one pixel is not limited to a combination of sub-pixels of three primary colors of R, G, and B and may be configured by adding sub-pixels of one or more colors to the sub-pixels of the three primary colors. Specifically, one pixel may be configured by providing a sub-pixel to emit white (W) light to improve brightness, in addition to the sub-pixels of the three primary colors. Alternatively, one pixel may be configured by providing at least one sub-pixel to emit complementary light to enlarge a color reproduction range, in addition to the sub-pixels of the three primary colors.

In the pixel array unit 30, scanning lines $\mathbf{31}_1$ to $\mathbf{31}_m$ and power supply lines $\mathbf{32}_1$ to $\mathbf{32}_m$ are provided along a row direction (arrangement direction of the pixels of pixel rows), for every pixel row, with respect to an arrangement of the pixels 20 of m rows and n columns. In addition, signal lines $\mathbf{33}_1$ to $\mathbf{33}_n$ are provided along a column direction (arrangement direction of the pixels of pixel columns), for every pixel column, with respect to the arrangement of the pixels 20 of the m rows and the n columns.

Each of the scanning lines $\mathbf{31}_1$ to $\mathbf{31}_m$ is connected to an output terminal of a corresponding row of the write scanning circuit 40. Each of the power supply lines $\mathbf{32}_1$ to $\mathbf{32}_m$ is connected to an output terminal of a corresponding row of the power supply scanning circuit 50. Each of the signal lines $\mathbf{33}_1$ to $\mathbf{33}_n$ is connected to an output terminal of a corresponding column of the signal output circuit 60.

The write scanning circuit 40 is configured using a shift register circuit that sequentially shifts (transmits) start pulses sp in synchronization with a clock pulse ck. The write scanning circuit 40 sequentially supplies write scanning signals WS ($WS_1$ to $WS_m$) to the scanning lines 31 ($\mathbf{31}_1$ to $\mathbf{31}_m$) and sequentially scans the individual pixels 20 of the pixel array unit 30 in a row unit (line-sequential scanning), when a signal voltage of a video signal is written to each pixel 20 of the pixel array unit 30.

The power supply scanning circuit 50 is configured using a shift register circuit that sequentially shifts the start pulses sp in synchronization with the clock pulse ck. The power supply scanning circuit 50 supplies, to the power supply lines 32 ($\mathbf{32}_1$ to $\mathbf{32}_m$), power supply potentials DS ($DS_1$ to $DS_m$), which can be switched into a first power supply potential $V_{ccp}$ and a second power supply potential $V_{ini}$ lower than the first power supply potential $V_{ccp}$, in synchronization with the line-sequential scanning by the write scanning circuit 40. As described below, the power supply potential DS is switched into $V_{ccp}/V_{ini}$, so that control of light emission/light non-emission (quenching) of the pixel 20 is performed.

The signal output circuit 60 selectively outputs a signal voltage $V_{sig}$ of a video signal according to brightness information supplied from a signal supply source (not illustrated in the drawings) (hereinafter, simply referred to as the "signal voltage") and a reference voltage $V_{ofs}$. In this case, the reference voltage $V_{ofs}$ is a voltage becoming a reference of the signal voltage $V_{sig}$ of the video signal (for example, a voltage corresponding to a black level of the video signal) and is used when threshold value correction processing to be described below is executed.

The signal voltage $V_{sig}$/reference voltage $V_{ofs}$ that is output from the signal output circuit 60 is written to each pixel 20 of the pixel array unit 30 through the signal lines 33 ($\mathbf{33}_1$ to $\mathbf{33}_n$), in a unit of the pixel row selected by scanning by the write scanning circuit 40. That is, the signal output circuit 60 adopts a driving type of line-sequential writing in which the signal voltage $V_{sig}$ is written in a row (line) unit.

[2-2. Pixel Circuit]

Figure 2:
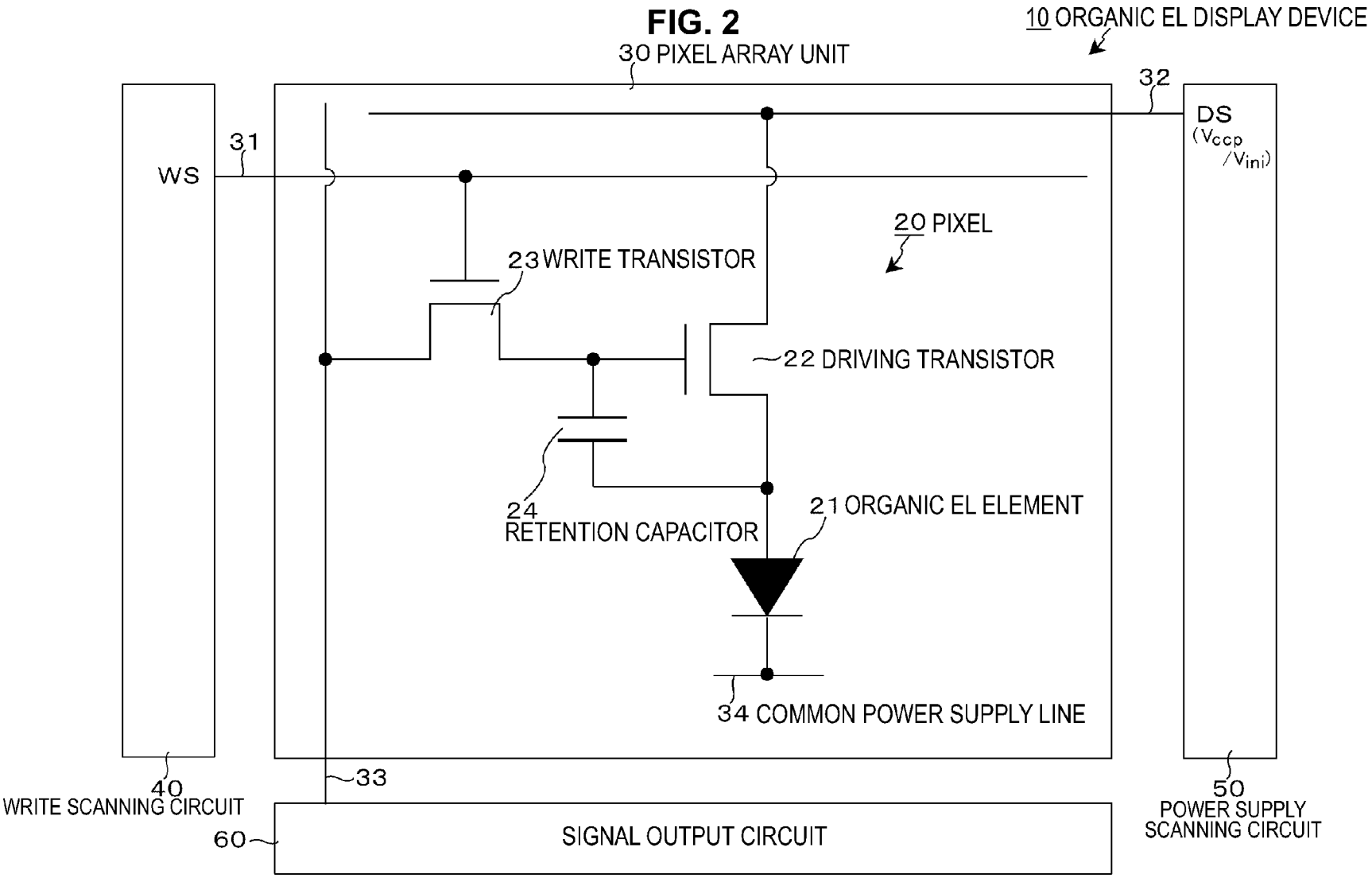
FIG. 2 is a circuit diagram illustrating an example of a specific circuit configuration of a pixel (pixel circuit)

FIG. 2 is a circuit diagram illustrating an example of a specific circuit configuration of the pixel (pixel circuit) 20. A light emitting unit of the pixel 20 is configured using an organic EL element 21 to be a current driving type electro-optical element of which light emission brightness changes according to a value of a current flowing to a device.

As illustrated in FIG. 2, the pixel 20 includes the organic EL element 21 and a driving circuit that drives the organic EL element 21 by making a current flow to the organic EL element 21. In the organic EL element 21, a cathode electrode is connected to a common power supply line 34 provided commonly with respect to all of the pixels 20.

The driving circuit that drives the organic EL element 21 includes a driving transistor 22, a write transistor 23, and a retention capacitor 24. As the driving transistor 22 and the write transistor 23, N-channel TFTs can be used. However, a combination of conductive types of the driving transistor 22 and the write transistor 23 that are illustrated herein is only exemplary and the combination of the conductive types thereof is not limited to a specific combination of conductive types.

In the driving transistor 22, one electrode (source/drain electrode) is connected to an anode electrode of the organic EL element 21 and the other electrode (source/drain electrode) is connected to the power supply line 32 ($\mathbf{32}_1$ to $\mathbf{32}_m$).

In the write transistor 23, one electrode (source/drain electrode) is connected to the signal line 33 ($\mathbf{33}_1$ to $\mathbf{33}_n$) and the other electrode (source/drain electrode) is connected to a gate electrode of the driving transistor 22. In addition, a gate electrode of the write transistor 23 is connected to the scanning line 31 ($\mathbf{31}_1$ to $\mathbf{31}_m$).

In the driving transistor 22 and the write transistor 23, one electrode means a metal wiring line that is electrically connected to one source/drain region and the other electrode means a metal wiring line that is electrically connected to the other source/drain region. By a potential relation of one electrode and the other electrode, if one electrode becomes a source electrode, one electrode becomes a drain electrode and if the other electrode becomes the drain electrode, the other electrode becomes the source electrode.

In the retention capacitor 24, one electrode is connected to the gate electrode of the driving transistor 22 and the other electrode is connected to the other electrode of the driving transistor 22 and the anode electrode of the organic EL element 21.

A circuit configuration of the driving circuit of the organic EL element 21 is not limited to a circuit configuration including two transistors of the driving transistor 22 and the write transistor 23 and one capacitor of the retention capacitor 24. For example, one electrode is connected to the anode electrode of the organic EL element 21 and the other electrode is connected to a fixed potential, so that a circuit configuration in which an auxiliary capacitor to make up for an insufficient capacity of the organic EL element 21 is provided according to necessity can be adopted.

In the pixel 20 having the above configuration, the write transistor 23 enters a conductive state in response to the write scanning signal WS that is applied from the write scanning circuit 40 to the gate electrode through the scanning line 31 and becomes active at a high level. Thereby, the write transistor 23 samples the signal voltage $V_{sig}$ of the video signal according to the brightness information to be supplied from the signal output circuit 60 through the signal line 33 or the reference voltage $V_{ofs}$ and writes the signal voltage $V_{sig}$ or the reference voltage $V_{ofs}$ to the pixel 20. The signal voltage $V_{sig}$ or the reference voltage $V_{ofs}$ that is written by the write transistor 23 is applied to the gate electrode of the driving transistor 22 and is retained in the retention capacitor 24.

When the power supply potential DS of the power supply line 32 (32$_1$ to 32$_m$) is at the first power supply potential $V_{ccp}$, one electrode and the other electrode of the driving transistor 22 become the drain electrode and the source electrode, respectively, and the driving transistor 22 is operated in a saturation region. Thereby, the driving transistor 22 receives a current supplied from the power supply line 32 and drives light emission of the organic EL element 21 by current driving. Specifically, the driving transistor 22 is operated in the saturation region, supplies a driving current having a current value according to a voltage value of the signal voltage $V_{sig}$ retained in the retention capacitor 24 to the organic EL element 21, and makes the organic EL element 21 emit light by the current driving.

When the power supply potential DS is switched from the first power supply potential $V_{ccp}$ to the second power supply potential $V_{ini}$, one electrode and the other electrode of the driving transistor 22 become the source electrode and the drain electrode, respectively, and the driving transistor 22 is operated as a switching transistor. Thereby, the driving transistor 22 stops supplying of the driving current with respect to the organic EL element 21 and makes the organic EL element 21 enter a light non-emission state. That is, the driving transistor 22 has a function as a transistor to control light emission/light non-emission of the organic EL element 21.

By setting a period (light non-emission period) in which the organic EL element 21 enters the light non-emission state by a switching operation of the driving transistor 22, a ratio (duty) of a light emission period and a light non-emission period of the organic EL element 21 can be controlled. Because it is possible to decrease residual image blur occurring due to light emission of the pixel over one display frame period by the duty control, an image quality of a moving image can be improved in particular.

The first power supply potential $V_{ccp}$ of the first and second power supply potentials $V_{ccp}$ and $V_{ini}$ that are supplied selectively from the power supply scanning circuit 50 through the power supply line 32 is a power supply potential to supply a driving current to drive light emission of the organic EL element 21 to the driving transistor 22. The second power supply potential $V_{ini}$ is a power supply potential to apply reverse bias to the organic EL element 21. The second power supply potential $V_{ini}$ is set to a potential lower than the reference voltage $V_{ofs}$. For example, when a threshold voltage of the driving transistor 22 is set to $V_{th}$, the second power supply potential $V_{ini}$ is set to a potential lower than $V_{ofs}-V_{th}$, preferably, a potential sufficiently tower than $V_{ofs}-V_{th}$.

[2-3. Basic Circuit Operation]

Next, a basic circuit operation of the organic EL display device 10 having the above configuration will be described using a timing waveform diagram of FIG. 3 and with reference to operation explanatory diagrams of FIGS. 4 to 11. In the operation explanatory diagrams of FIGS. 4 to 11, the write transistor 23 is illustrated by a symbol of a switch to simplify the drawings and an equivalent capacitor 25 of the organic EL element 21 is also illustrated.

Figure 3:
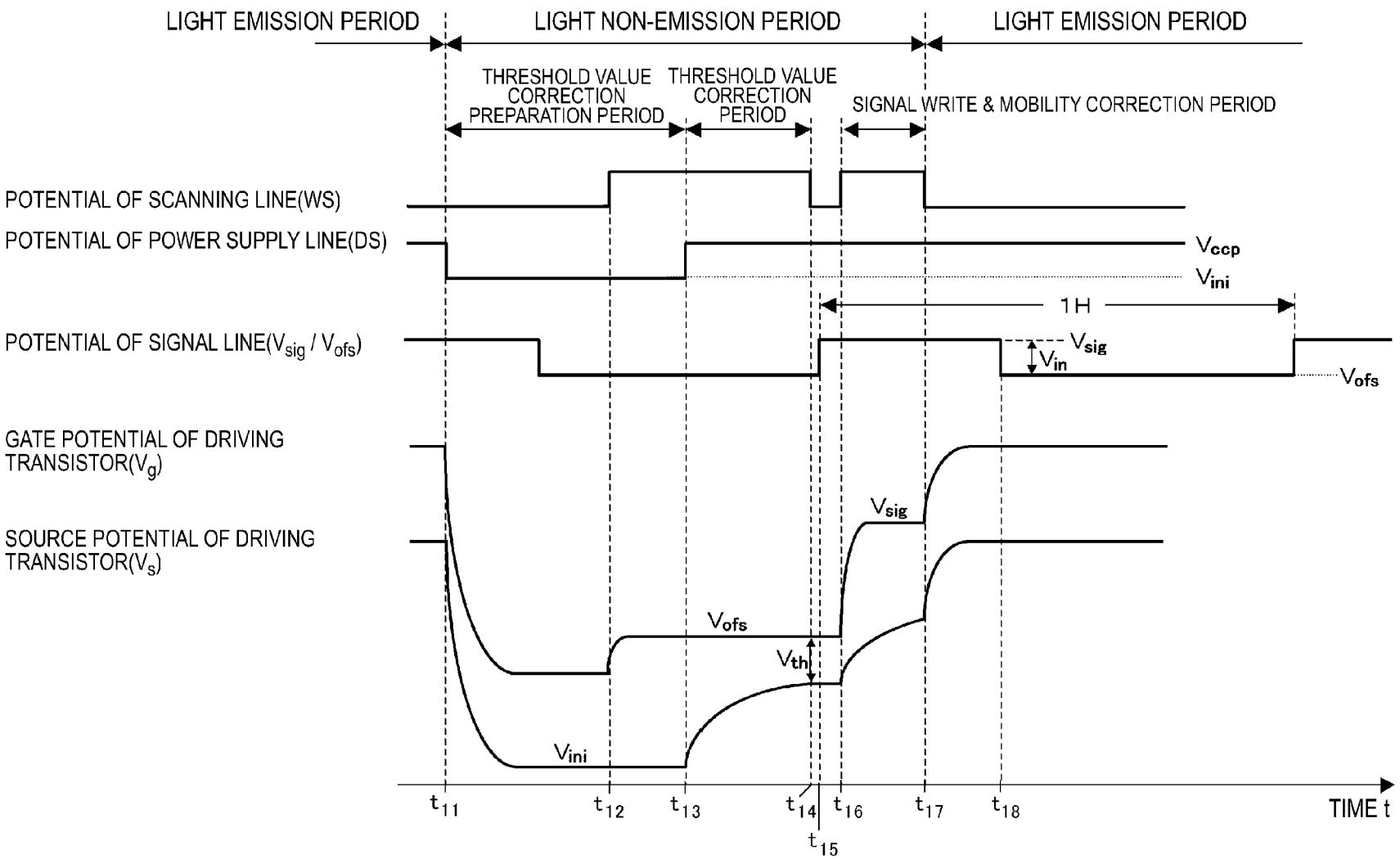
FIG. 3 is a timing waveform diagram illustrating a basic circuit operation of an active matrix type organic EL display device to which the present disclosure is applied.

The timing waveform diagram of FIG. 3 illustrates a change of each of the potential (write scanning signal) WS of the scanning line 31, the potential (power supply potential) DS of the power supply line 32, the potential ($V_{sig}/V_{ofs}$) of the signal line 33, and the gate potential $V_g$ and the source potential $V_s$ of the driving transistor 22.

(Light Emission Period of Previous Display Frame)

In the timing waveform diagram of FIG. 3, a period before a time $t_{11}$ becomes a light emission period of the organic EL element 21 in a previous display frame. In the light emission period of the previous display frame, the potential DS of the power supply line 32 is at the first power supply potential (hereinafter, referred to as a "high potential") and the write transistor 23 is in a non-conductive state.

Figure 4:
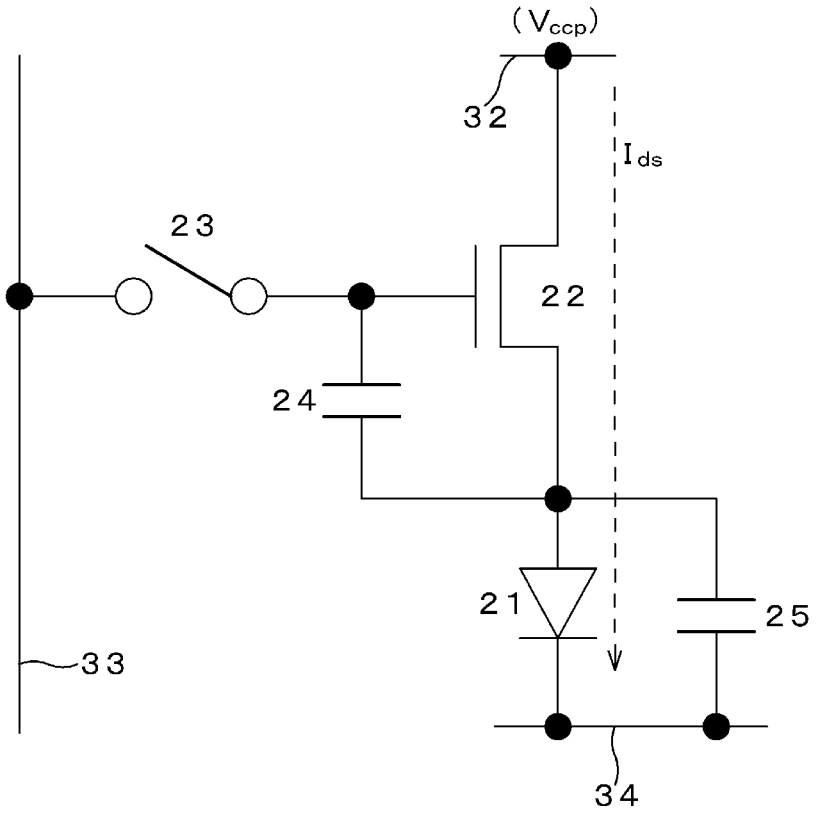
FIG. 4 is an (first) operation explanatory diagram of a basic circuit operation of an active matrix type organic EL display device to which the present disclosure is applied.

At this time, the driving transistor 22 is set to be operated in the saturation region. Thereby; as illustrated in FIG. 4, a driving current (drain-source current) $I_{ds}$ according to a gate-source voltage $V_{gs}$ of the driving transistor 22 is supplied from the power supply line 32 to the organic EL element 21 through the driving transistor 22. Therefore, the organic EL element 21 emits light with brightness according to a current value of the driving current $I_{ds}$.

(Threshold Value Correction Preparation Period)

Figure 5:
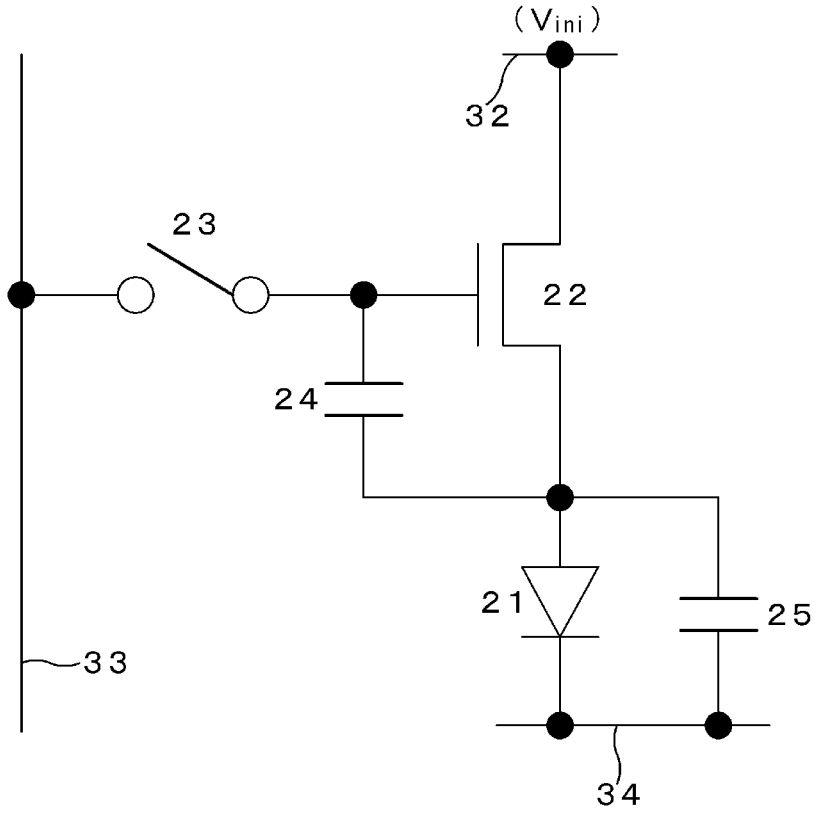

If a time becomes the time $t_{11}$, a new display frame (current display frame) of the line-sequential scanning starts. As illustrated in FIG. 5, the potential DS of the power supply line 32 is switched from the high potential $V_{ccp}$ to the second power supply potential (hereinafter, referred to as a "low potential") $V_{ini}$. The low potential $V_{ini}$ is a potential that is sufficiently lower than $V_{ofs}-V_{th}$ with respect to the reference voltage $V_{ofs}$ of the signal line 33.

In this case, the threshold voltage of the organic EL element 21 is set to $V_{the1}$ and the potential (cathode potential) of the common power supply line 34 is set to $V_{cath}$. At this time, if the low potential $V_{ini}$ is set to $V_{ini}<V_{the1}+V_{cath}$, the organic EL element 21 enters a reverse bias state and quenches, because the source potential $V_s$ of the driving transistor 22 becomes almost equal to the low potential $V_{ini}$.

Figure 6:
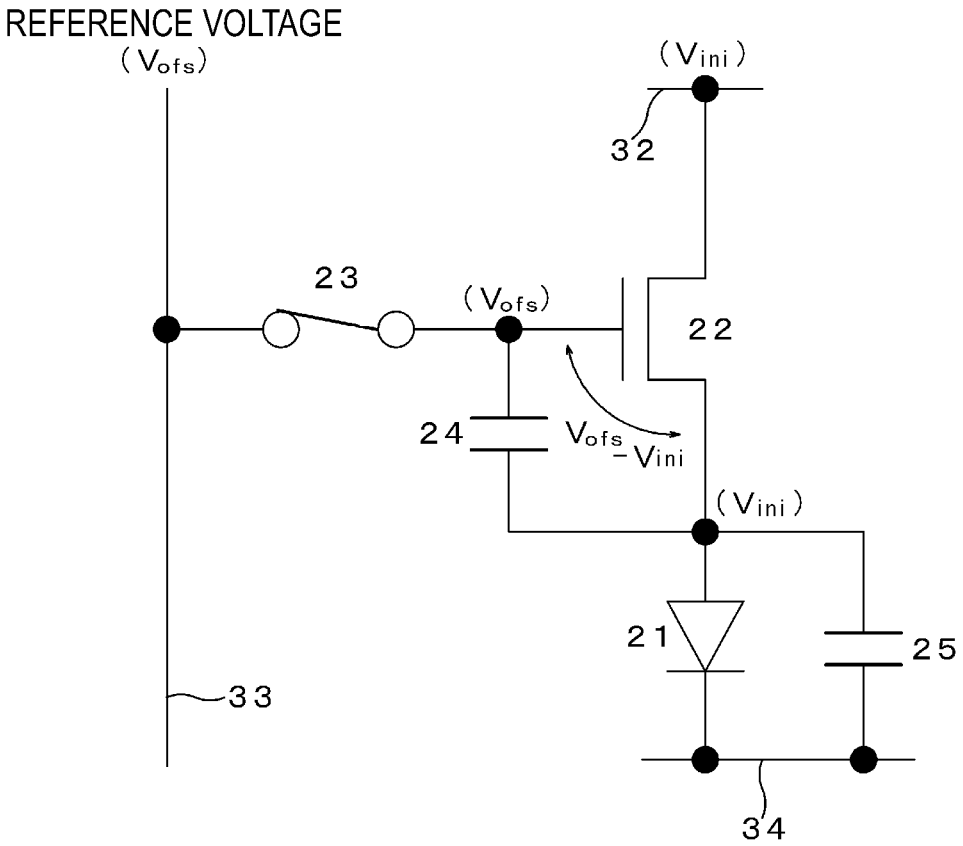

Next, at a time $t_{12}$, the potential WS of the scanning line 31 changes from the low potential side to the high potential side, so that the write transistor 23 enters a conductive state, as illustrated in FIG. 6. At this time, because the reference voltage $V_{ofs}$ is supplied from the signal output circuit 60 to the signal line 33, the gate potential $V_g$ the driving transistor 22 becomes the reference voltage $V_{ofs}$. The source potential $V_s$ of the driving transistor 22 is at the potential sufficiently lower than the reference voltage $V_{ofs}$, that is, the low potential $V_{ini}$.

At this time, the gate-source voltage $V_{gs}$ of the driving transistor 22 becomes $V_{ofs}-V_{ini}$. If $V_{ofs}-V_{ini}$ is not more than the threshold voltage $V_{th}$ of the driving transistor 22, threshold value correction processing (threshold value correction operation) to be described below may not be executed. For this reason, it is necessary to set a potential relation of $V_{ofs}-V_{ini}>V_{th}$.

As such, processing for fixing the gate potential $V_g$ of the driving transistor 22 to the reference voltage $V_{ofs}$ and fixing the source potential $V_s$ to the low potential $V_{ini}$ to perform initialization is preparation (threshold value correction preparation) processing before executing the threshold value correction processing (threshold value correction operation) to be described below. Therefore, the reference voltage $V_{ofs}$ and the low potential $V_{ini}$ become initialization voltages of the gate potential $V_g$ and the source potential $V_s$ of the driving transistor 22.

(Threshold Value Correction Period)

Figure 7:
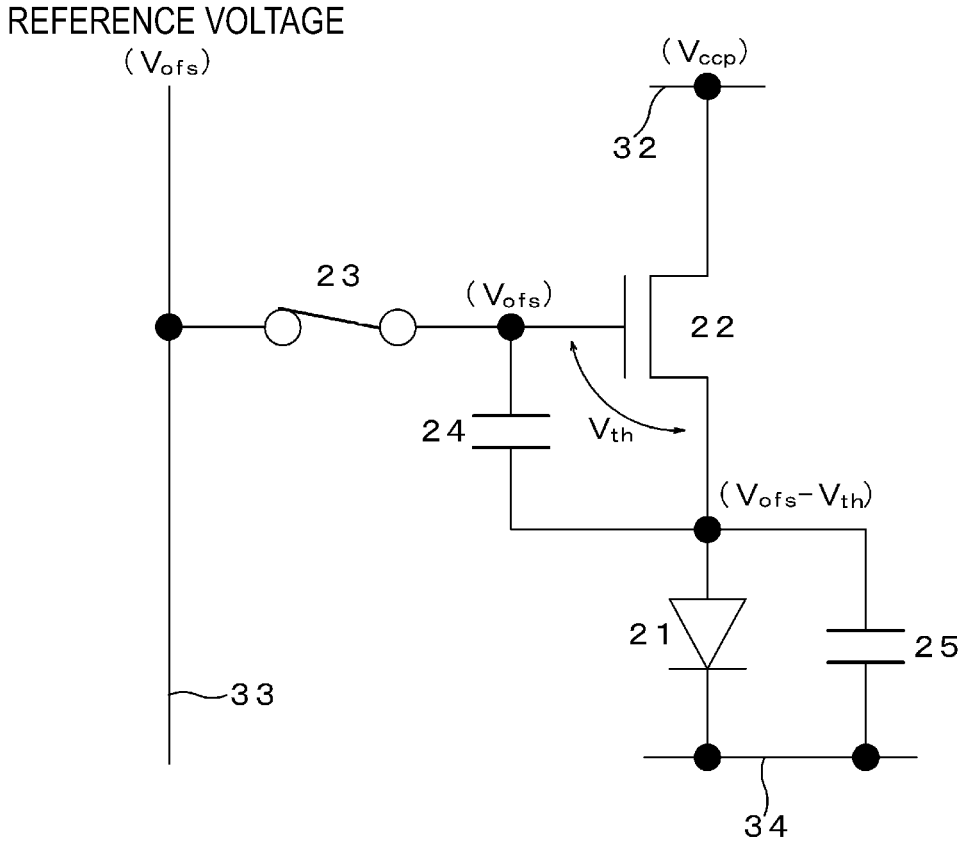

Next, at a time $t_{13}$, as illustrated in FIG. 7, if the potential DS of the power supply line 32 is switched from the low potential $V_{ini}$ to the high potential $V_{ccp}$, the threshold value correction processing starts in a state in which the gate potential $V_g$ of the driving transistor 22 is maintained at the reference voltage $V_{ofs}$. That is, the source potential $V_s$ of the driving transistor 22 starts to increase to the potential obtained by subtracting the threshold voltage $V_{th}$ of the driving transistor 22 from the gate potential $V_g$.

In this case, for the convenience of explanation, processing for setting the initialization voltage $V_{ofs}$ of the gate potential $V_g$ of the driving transistor 22 to the reference voltage and changing the source potential $V_s$ to the potential obtained by subtracting the threshold voltage $V_{th}$ of the driving transistor 22 from the initialization voltage $V_{ofs}$ is called the threshold value correction processing. If the threshold value correction processing advances, the gate-source voltage $V_{gs}$ of the driving transistor 22 eventually converges to the threshold voltage $V_{th}$ of the driving transistor 22. The voltage that corresponds to the threshold voltage $V_{th}$ is retained in the retention capacitor 24.

In the period in which the threshold value correction processing is executed (threshold value correction period), the potential $V_{cath}$ of the common power supply line 34 is set to make the organic EL element 21 enter a cutoff state, such that a current flows to only the side of the retention capacitor 24 and does not flow to the side of the organic EL element 21.

Figure 8:
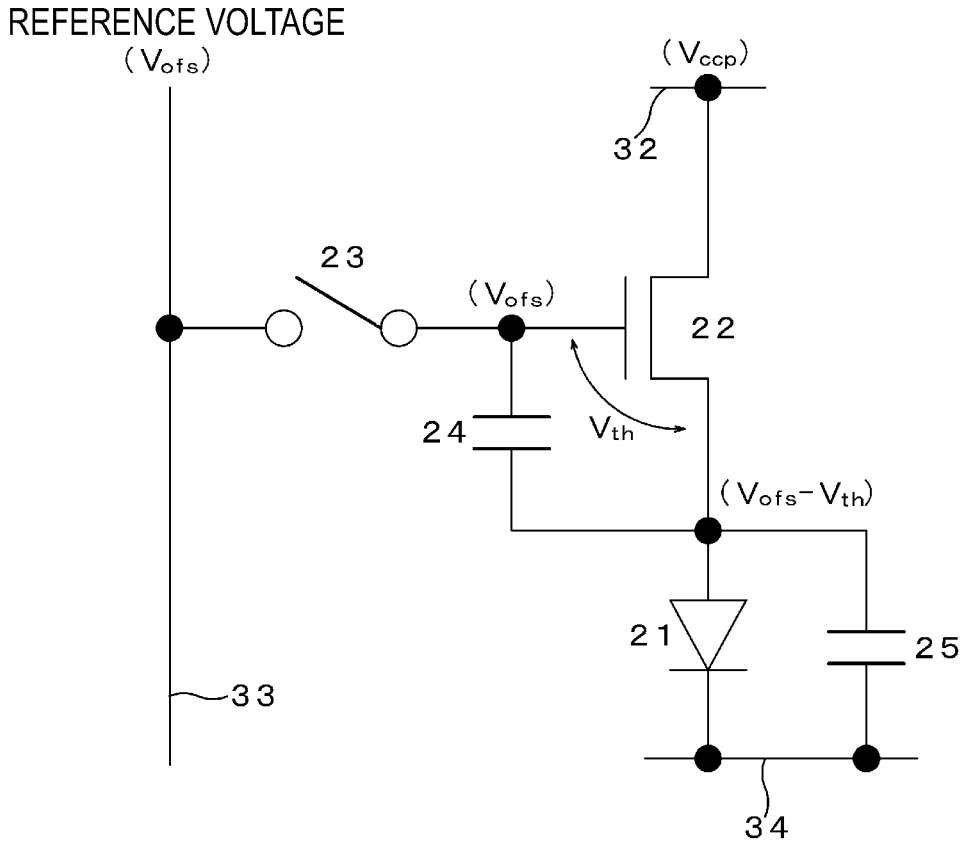

Next, at a time $t_{14}$, the potential WS of the scanning line 31 changes to the low potential side, so that the write transistor 23 enters a non-conductive state, as illustrated in FIG. 8. At this time, the gate electrode of the driving transistor 22 is electrically isolated from the signal line 33 and enters a floating state. However, because the gate-source voltage $V_{gs}$ is equal to the threshold voltage $V_{th}$ of the driving transistor 22, the driving transistor 22 is in a cutoff state. Therefore, the drain-source current $I_{ds}$ does not flow to the driving transistor 22.

(Signal Write & Mobility Correction Period)

Figure 9:
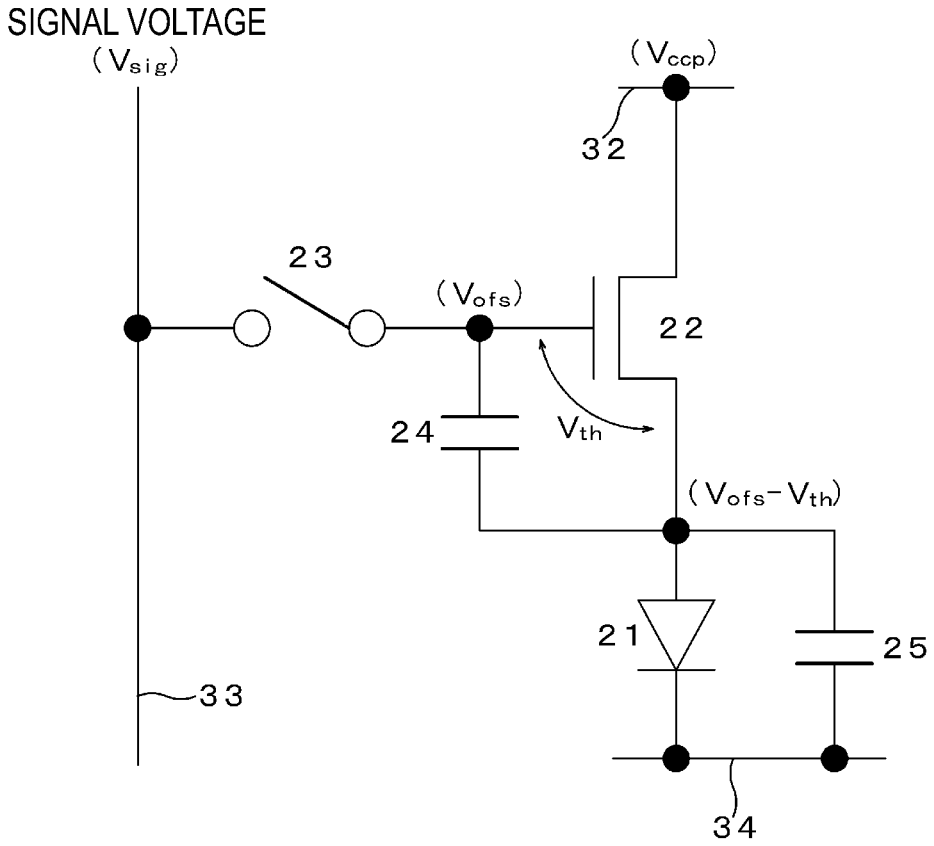
Figure 10:
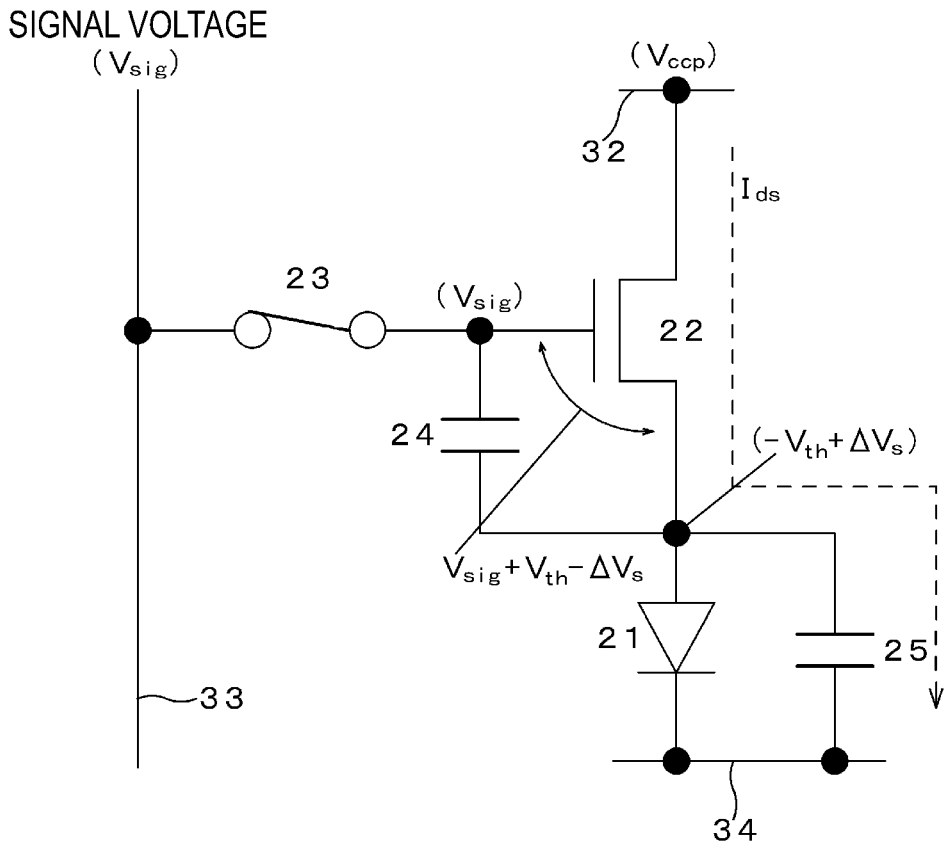

Next, at a time $t_{15}$, as illustrated in FIG. 9, the potential of the signal line 33 is switched from the reference voltage $V_{ofs}$ to the signal voltage $V_{sig}$ of the video signal. Next, at a time $t_{16}$, the potential WS of the scanning line 31 changes to the high potential side, so that the write transistor 23 enters a conductive state, samples the signal voltage $V_{sig}$ of the video signal, and writes the signal voltage to the pixel 20, as illustrated in FIG. 10.

By writing the signal voltage $V_{sig}$ by the write transistor 23, the gate potential $V_g$ of the driving transistor 22 becomes the signal voltage $V_{sig}$. When the driving transistor 22 is driven by the signal voltage $V_{sig}$ of the video signal, the threshold voltage $V_{th}$ of the driving transistor 22 is cancelled by a voltage corresponding to the threshold voltage $V_{th}$ retained in the retention capacitor 24.

At this time, the organic EL element 21 is in a cutoff state (high impedance state). Therefore, the current (drain-source current $I_{ds}$) that flows from the power supply line 32 to the driving transistor 22 according to the signal voltage $V_{sig}$ of the video signal flows to the equivalent capacitor 25 of the organic EL element 21. Thereby, charging of the equivalent capacitor 25 of the organic EL element 21 starts.

The equivalent capacitor 25 of the organic EL element 21 is charged, so that the source potential $V_s$ of the driving transistor 22 increases over time. At this time, a variation of the threshold voltage $V_{th}$ of the driving transistor 22 for each pixel is already cancelled and the drain-source current $I_{ds}$ of the driving transistor 22 depends on the mobility μ of the driving transistor 22. The mobility μ of the driving transistor 22 is mobility of a semiconductor thin film that constitutes a channel of the driving transistor 22.

Here, it is assumed that a ratio of the retention voltage $V_{gs}$ of the retention capacitor 24 with respect to the signal voltage $V_{sig}$ of the video signal, that is, write gain G is 1 (ideal value). In this case, the source potential $V_s$ of the driving transistor 22 increases to a potential of $V_{ofs}-V_{th}+\Delta V$, so that the gate-source voltage $V_{gs}$ of the driving transistor 22 becomes $V_{sig}-V_{ofs}+V_{th}-\Delta V_s$.

That is, an increased potential $\Delta V_s$ of the source potential $V_s$ of the driving transistor 22 is deducted from the voltage $(V_{sig}-V_{ofs}+V_{th})$ retained in the retention capacitor 24, that is, charging charges of the retention capacitor 24 are discharged. In other words, the increased potential (change amount) $\Delta V_s$ of the source potential $V_s$ of the driving transistor 22 is generated by applying the negative feedback to the retention capacitor 24. Therefore, the increased potential $\Delta V_s$ of the source potential $V_s$ becomes a feedback amount of the negative feedback.

As such, the negative feedback is applied to the gate-source voltage $V_{gs}$ with the feedback amount $\Delta V_s$ according to the drain-source current $I_{ds}$ flowing to the driving transistor 22 to cancel dependency of the drain-source current $I_{ds}$ of the driving transistor 22 with respect to the mobility μ. The cancellation processing is mobility correction processing for correcting the variation of the mobility μ of the driving transistor 22 for each pixel.

Specifically, because the drain-source current $I_{ds}$ increases when signal amplitude $V_{in}(=V_{sig}-V_{ofs})$ of the video signal written to the gate electrode of the driving transistor 22 increases, an absolute value of the feedback amount $\Delta V_s$ of the negative feedback increases. Therefore, the mobility correction processing according to a light emission brightness level is executed.

When the signal amplitude $V_{in}$ of the video signal is constant, the absolute value of the feedback amount $\Delta V_s$ of the negative feedback increases when the mobility μ of the driving transistor 22 increases. For this reason, the variation of the mobility μ for each pixel can be removed. Therefore, the feedback amount $\Delta V_s$ of the negative feedback is also called a correction amount of the mobility correction processing.

(Light Emission Period)

Figure 11:
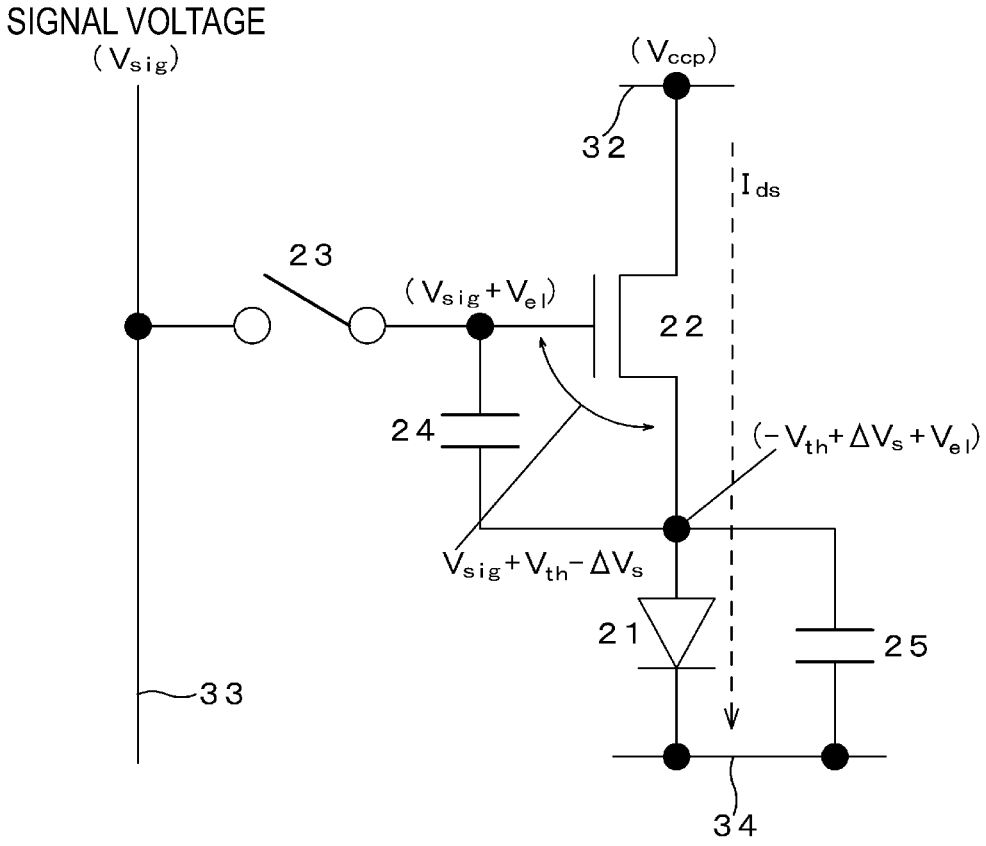

Next, at a time $t_{17}$, the potential WS of the scanning line 31 changes to the low potential side, so that the write transistor 23 enters a non-conductive state, as illustrated in FIG. 11. Thereby, because the gate electrode of the driving transistor 22 is electrically isolated from the signal line 33, the gate electrode enters a floating state.

In this case, when the gate electrode of the driving transistor 22 is in a floating state, the retention capacitor 24 is connected between the gate and the source of the driving transistor 22, so that the gate potential $V_g$ changes in tandem with a change in the source potential $V_s$ of the driving transistor 22. That is, the source potential $V_s$ and the gate potential $V_g$ of the driving transistor 22 increase in a state in which the gate-source voltage $V_{gs}$ retained in the retention capacitor 24 is retained. In addition, the source potential $V_s$ of the driving transistor 22 increases to a light emission voltage $V_{oled}$ of the organic EL element 21 according to a saturation current $I_{ds}$ of the transistor.

As such, an operation in which the gate potential $V_g$ of the driving transistor 22 changes in tandem with the change in the source potential $V_s$ is a bootstrap operation. In other words, the bootstrap operation is an operation in which the gate potential $V_g$ and the source potential $V_s$ change, in a state in which the gate-source voltage $V_{gs}$ retained in the retention capacitor 24, that is, a voltage between both ends of the retention capacitor 24 is retained.

At the same time as when the gate electrode of the driving transistor 22 enters a floating state, the drain-source current $I_{ds}$ of the driving transistor 22 starts to flow to the organic EL element 21, so that the anode potential of the organic EL element 21 increases according to the drain-source current $I_{ds}$. If the anode potential of the organic EL element 21 is more than $V_{thel}+V_{cath}$, the organic EL element 21 starts light emission, because a driving current starts to flow to the organic EL element 21.

A light emission current of the organic EL element 21 is defined by the saturation current $I_{ds}$ of the driving transistor 22 by the gate-source voltage $V_{gs}$ at that time. For this reason, the driving transistor 22 becomes a constant current source at each signal voltage $V_{sig}$.

An increase in the anode potential of the organic EL element 21 is an increase in the source potential $V_s$ of the driving transistor 22. If the source potential $V_s$ of the driving transistor 22 increases, the gate potential $V_g$ of the driving transistor 22 increases in tandem with the increase in the source potential $V_s$, by the bootstrap operation of the retention capacitor 24.

At this time, when it is assumed that bootstrap gain is 1 (ideal value), an increased amount of the gate potential $V_g$ becomes equal to an increased amount of the source potential $V_s$. For this reason, during the light emission period, the gate-source voltage $V_{gs}$ of the driving transistor 22 is retained constantly at $V_{sig}-V_{ofs}+V_{th}-\Delta V_s$. At a time $t_{18}$, the potential of the signal line 33 is switched from the signal voltage $V_{sig}$ of the video signal to the reference voltage $V_{ofs}$.

In the series of circuit operations described above, each processing operation of the threshold value correction preparation, the threshold value correction, the writing of the signal voltage $V_{sig}$ (signal write), and the mobility correction is executed in one horizontal period (1H). In addition, each processing operation of the signal write and the mobility correction is executed in parallel, in a period from a time $t_{16}$ to a time $t_{17}$.

[Division Threshold Value Correction]

The case in which the driving method of executing the threshold value correction processing only once is adopted has been described. However, the driving method is only exemplary and is not limited in particular. For example, a driving method of executing so-called division threshold value correction where the threshold value correction processing is divided and is executed several times over the 1H period in which the threshold value correction processing is executed together with the mobility correction processing and the signal write processing and a plurality of horizontal periods before the 1H period can be adopted.

According to the driving method of executing the division threshold value correction, even though a time allocated as one horizontal period becomes short due to more pixels according to high definition, a sufficient time can be secured over the plurality of horizontal periods functioning as the threshold value correction period. Therefore, even though the time allocated as one horizontal period becomes short, the sufficient time can be secured as the threshold value correction period. As a result, the threshold value correction processing can be securely executed.

[2-4. Case in Which TFT is Formed Over Semiconductor]

Here, the case in which a TFT used as the driving transistor 22 or the write transistor 23 is formed over a semiconductor such as silicon, not an insulator such as a glass substrate, is considered.

Figure 12:
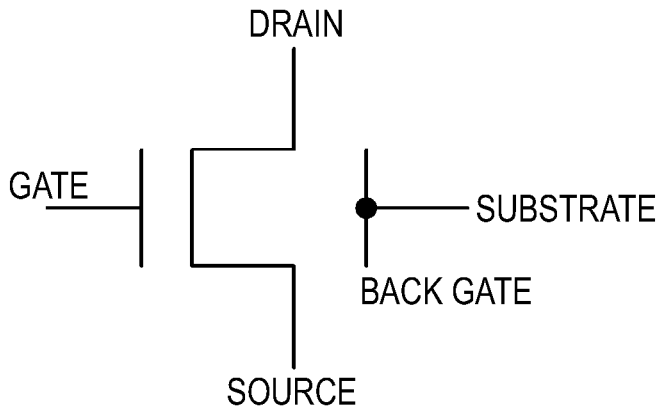
FIG. 12 is a diagram illustrating the case in which a TFT is formed over a semiconductor.
Figure 12:
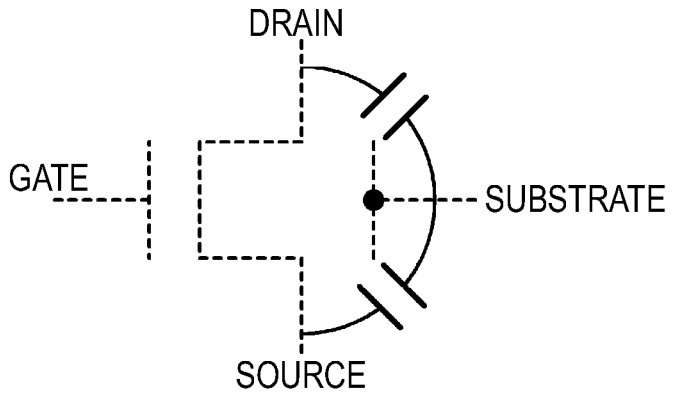

When the TFT is formed over the semiconductor, as illustrated in FIG. 12, the TFT becomes a four-terminal element of a source terminal, a gate terminal, a drain terminal, and a back gate (base) terminal, not a three-terminal element of the source terminal, the gate terminal, and the drain terminal. A parasitic capacitor exists between the source terminal, the gate terminal, and the drain terminal (electrode) and a substrate.

Figure 13:
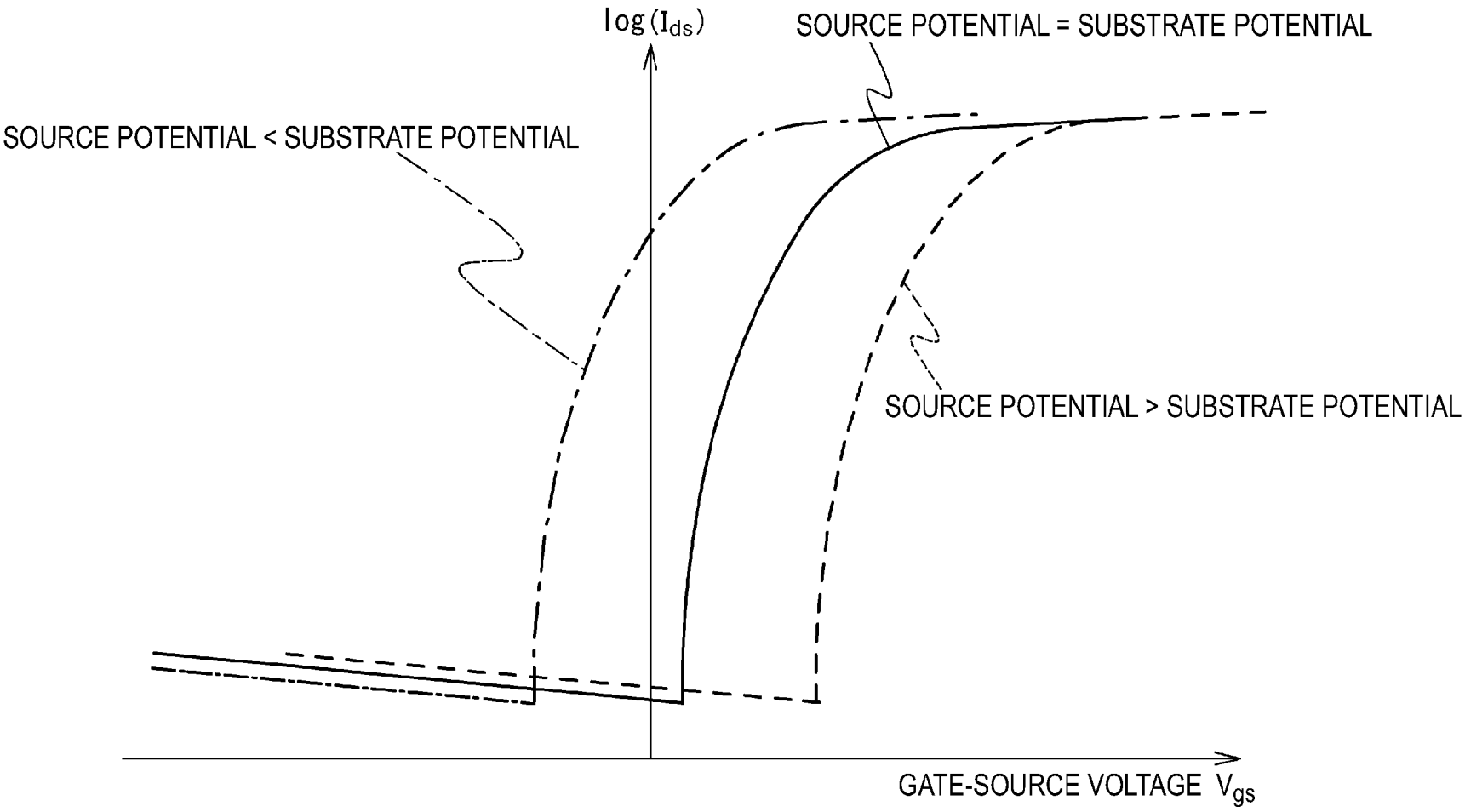
FIG. 13 is a diagram illustrating a TFT characteristic in the case in which a TFT is formed over a semiconductor.

When the TFT is formed over the semiconductor, as illustrated in FIG. 13, a characteristic of the TFT is changed by the substrate potential. Specifically, if a difference of the substrate potential and the source potential is positive (substrate potential>source potential), a threshold voltage of the TFT is shifted to an enhancement side. In contrast, if the difference of the substrate potential and the source potential is negative (substrate potential<source potential), the threshold voltage of the TFT is shifted to a depression side.

Here, each of an effect of the parasitic capacitor existing between the terminals of the transistor and the substrate and an effect of the characteristic change by the potential difference of the source potential and the substrate potential is considered.

Figure 14:
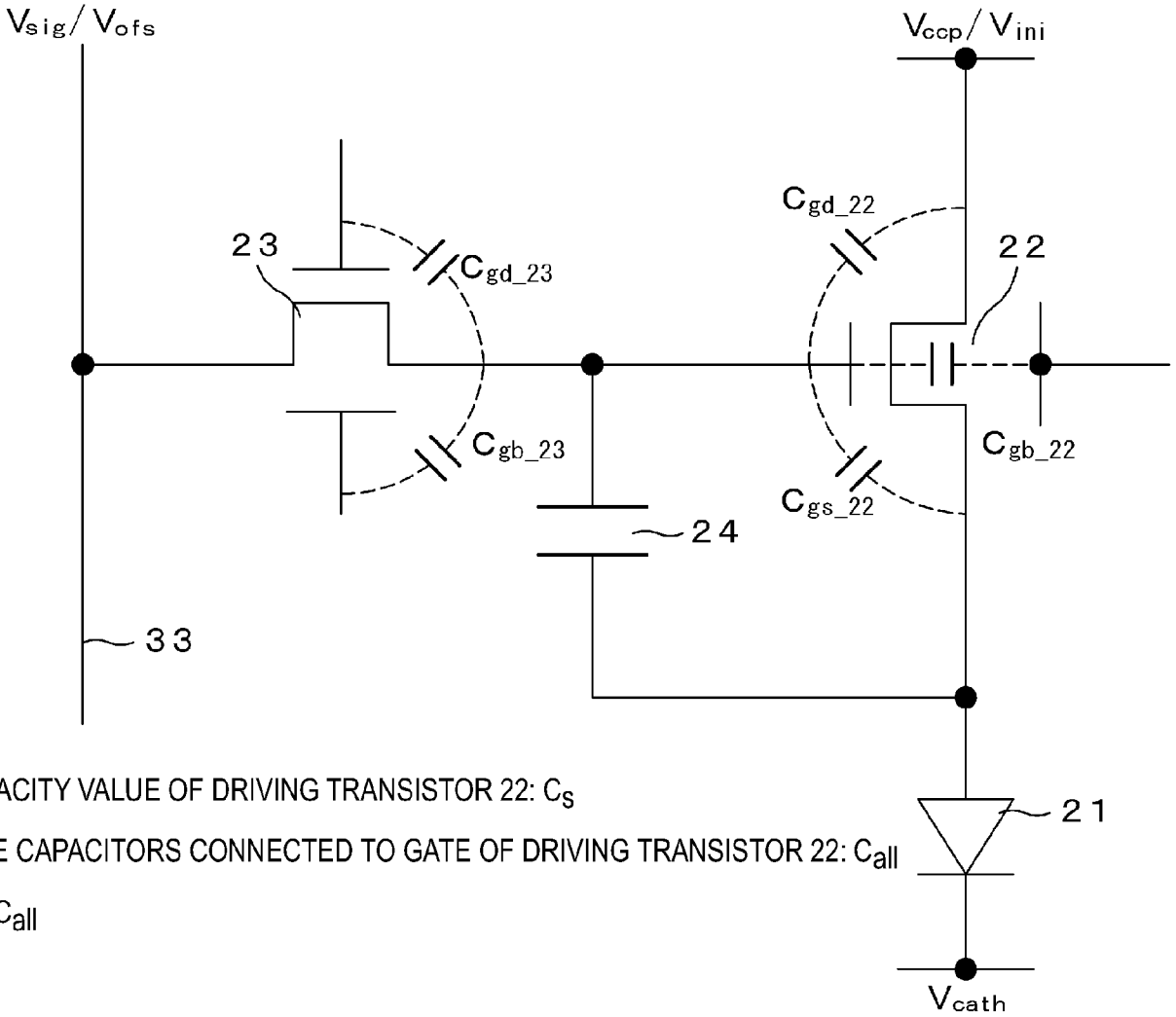
FIG. 14 is an equivalent circuit diagram of parasitic capacities of a driving transistor and a write transistor.

When the four-terminal transistor illustrated in FIG. 12 is used in the pixel circuit of FIG. 2, a parasitic capacitor is generated in the gate electrode (terminal) of the driving transistor 22, as illustrated in FIG. 14. At this time, if a capacity value of entire capacitors connected to the gate electrode of the driving transistor 22 is set to $C_{all}$ and a gate-source capacity value of the driving transistor 22 is set to $C_s$, the bootstrap gain G in the bootstrap operation becomes $C_s/C_{all}$.

In this case, the capacity value $C_{all}$ is an entire capacity value of a gate-source capacitor $C_{gs_22}$, a gate-drain capacitor $C_{gd_22}$, and a gate-back gate capacitor $C_{gb_22}$ of the driving transistor 22, a gate-drain capacitor $C_{gd_23}$ and a gate-back gate capacitor $C_{gb_23}$ of the write transistor 23, and the retention capacitor 24. The capacity value $C_s$ is an entire capacity value of the gate-source capacitor $C_{gs_22}$ of the driving transistor 22 and the retention capacitor 24.

The bootstrap gain G shows a ratio of a change (variation amount) of the gate potential with respect to a change (variation amount) of the source potential of the driving transistor 22. That is, if the bootstrap gain G is 1 (ideal value), the change of the gate potential becomes matched with the change of the source potential of the driving transistor 22. If the capacity other than the gate-source capacity of the driving transistor 22 is very smaller than the gate-source capacity, the gate-source voltage $V_{gs}$ of the driving transistor 22 is retained almost constantly when the organic EL element 21 emits light.

Figure 15:
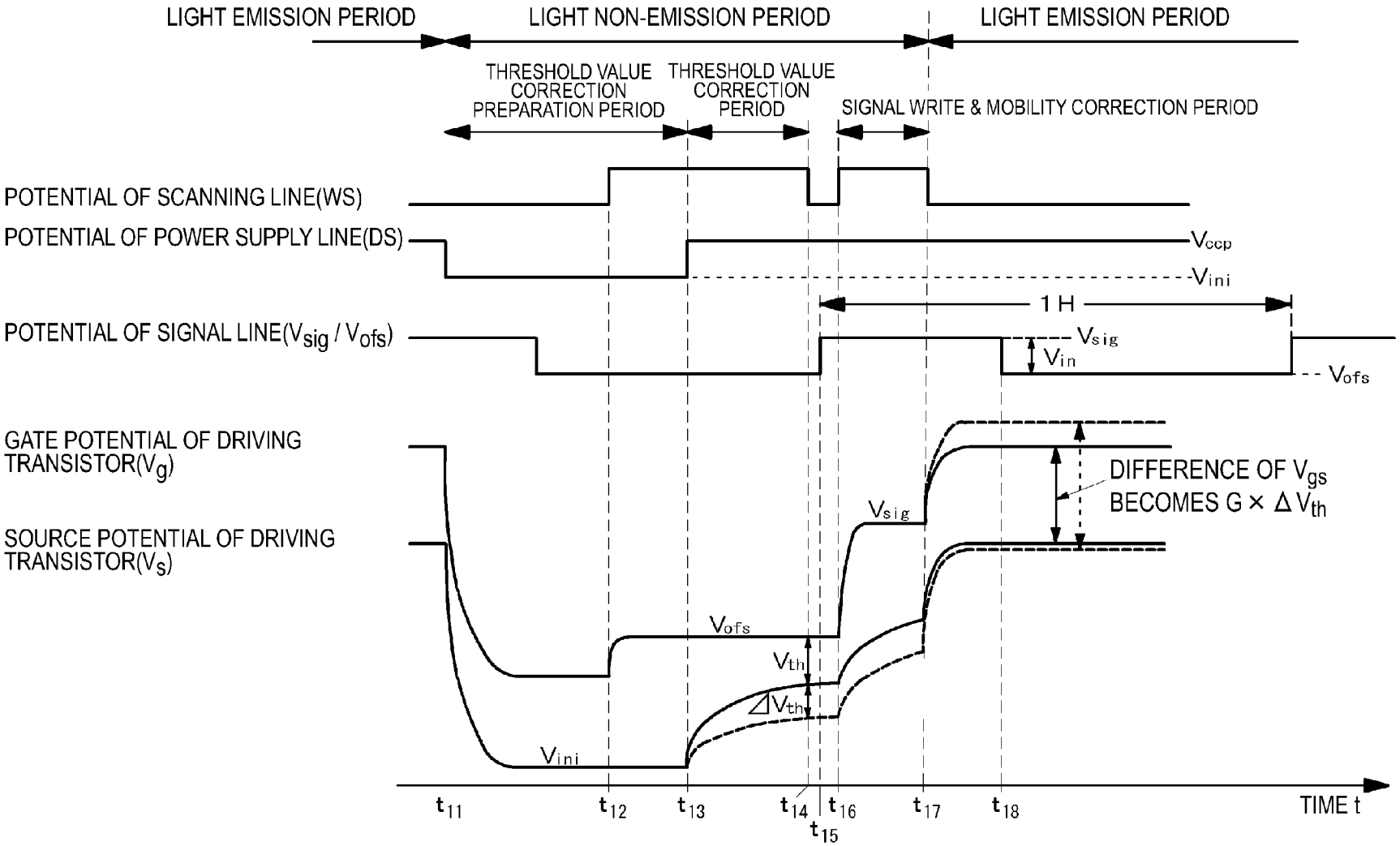
FIG. 15 is a timing waveform diagram illustrating an operation in the case in which a TFT is formed over a semiconductor.

However, as illustrated in FIG. 14, when the parasitic capacitor exists between each terminal of the transistor and the substrate, the bootstrap gain G decreases because the capacity other than the gate-source capacity of the driving transistor 22 may become more than the gate-source capacity. Thereby, as illustrated in FIG. 15, if a difference ($=\Delta V_{th}$) exists in the threshold voltage $V_{th}$ of the driving transistor 22 between the pixels, a difference ($G\times\Delta V_{th}$) of the gate-source voltage $V_{gs}$ of the driving transistor 22 when light emits may become smaller than $\Delta V_{th}$ and $\Delta V_{th}$ may not be perfectly reflected. As a result, a brightness irregularity or roughness occurs in a display image and image quality of the display image is deteriorated.

Figure 16:
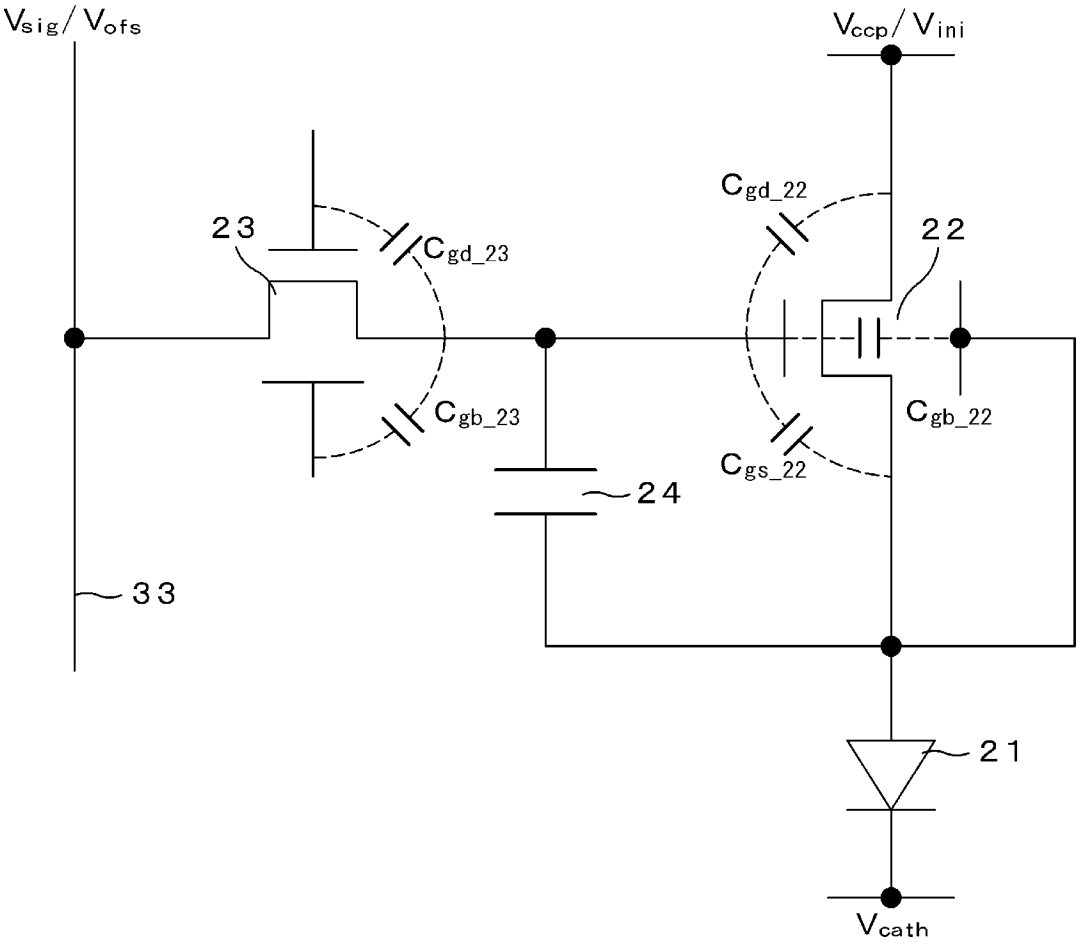
FIG. 16 is a circuit diagram illustrating an example of a method of decreasing capacity values of parasitic capacitors attached to a gate electrode of a driving transistor.

In order to increase the bootstrap gain G, the capacity value of the parasitic capacitor that is attached to the gate electrode of the driving transistor 22 may be decreased. For example, as illustrated in FIG. 16, a method of decreasing the capacity value of the parasitic capacitor between the gate electrode of the driving transistor 22 and the substrate by connecting the source electrode of the driving transistor 22 and the substrate, that is, equalizing the source potential $V_s$ and the substrate potential is considered.

Figure 17:
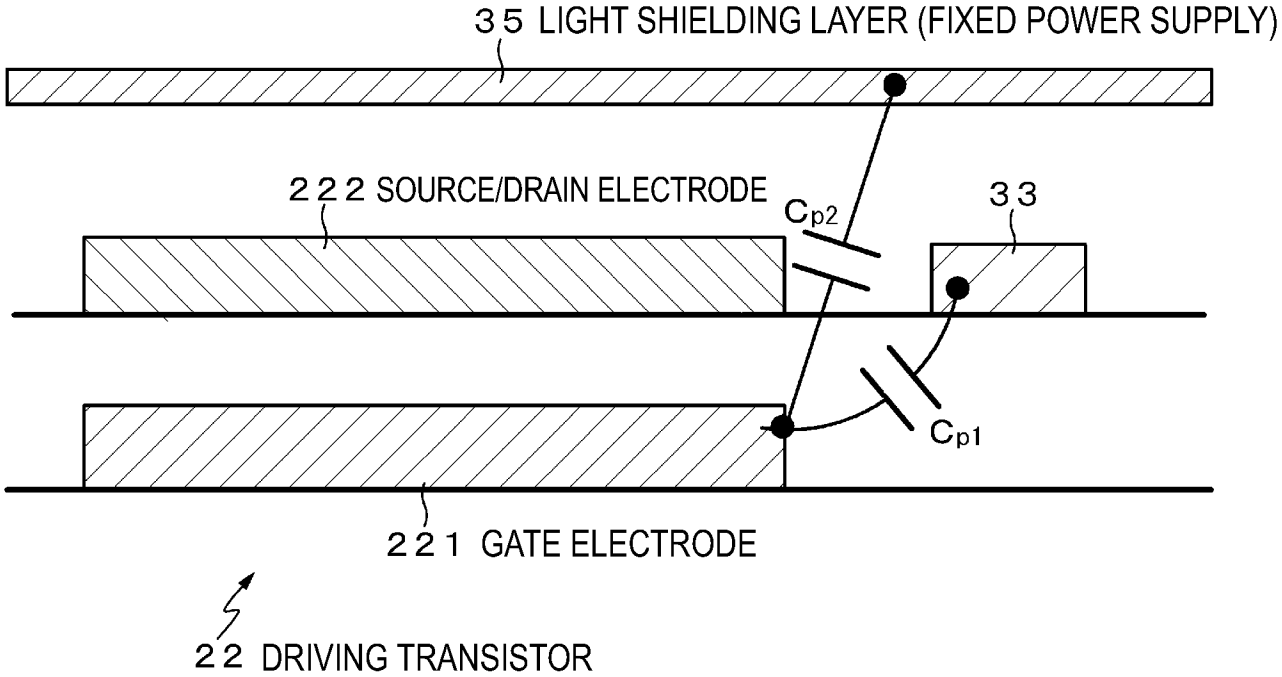
FIG. 17 is a cross-sectional view illustrating a multi-layer wiring structure adopted by a process for forming a TFT over a semiconductor substrate.

However, in a process for forming the TFT over a semiconductor substrate such as a silicon substrate, as illustrated in FIG. 17, it is general to perform multi-layering of a wiring line including a signal line 33 or a gate electrode 221 and a source/drain electrode 222 of the driving transistor 22. A light shielding layer 35 supplied with fixed power is arranged to decrease an influence of external light with respect to a circuit element such as the driving transistor 22. However, if a multi-layer wiring structure is implemented, parasitic capacitors $C_{p1}$ and $C_{p2}$ may be generated between the gate electrode 221 of the driving transistor 22 and a metal (in an example of FIG. 17, the signal line 33 or the light shielding layer 35) of other layer.

Figure 18:
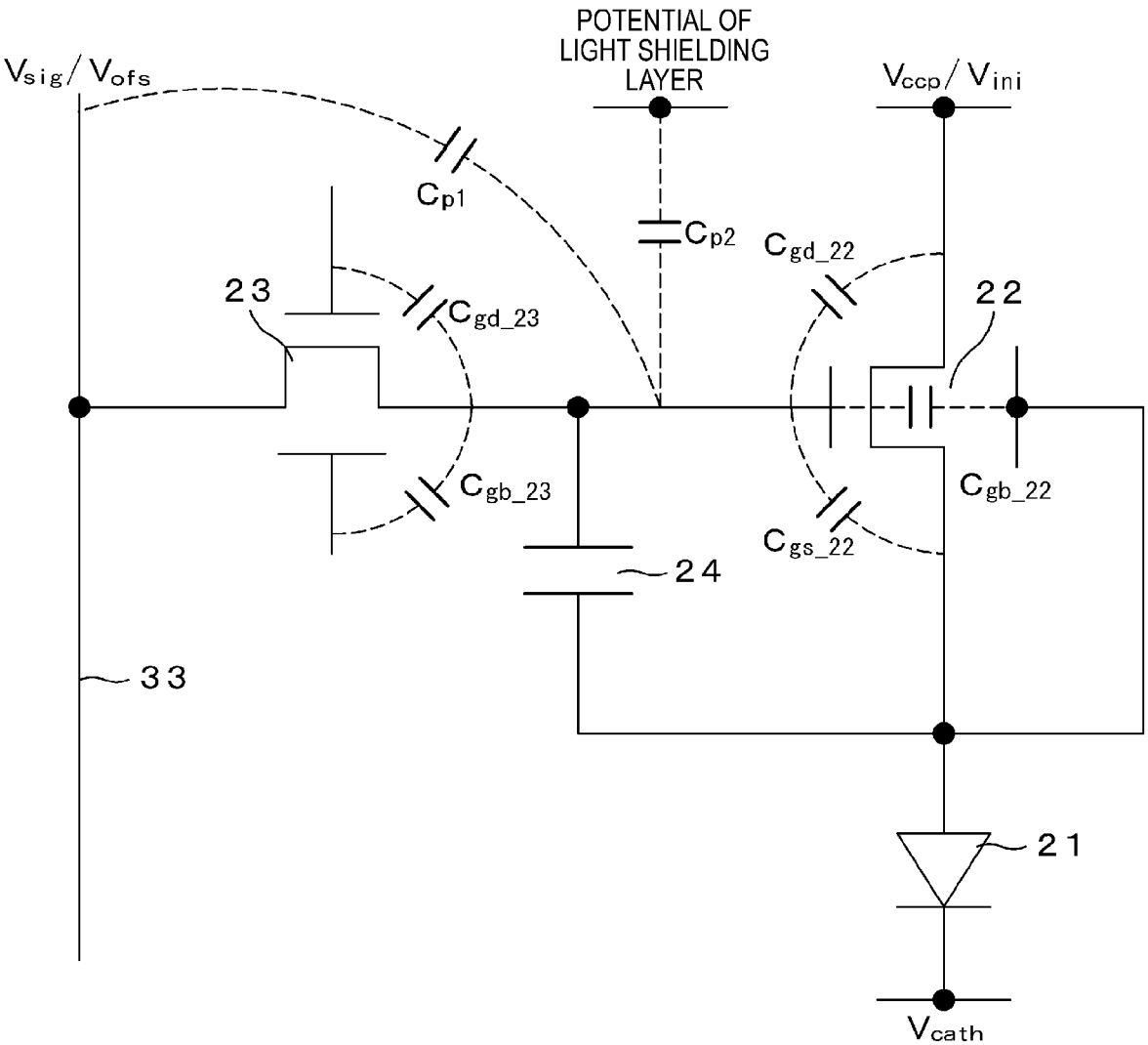
FIG. 18 is an equivalent circuit diagram of parasitic capacitors attached to a gate electrode of a driving transistor in the case of a multi-layer wiring structure.

As such, if the multi-layer wiring structure is implemented when the TFT is formed over the semiconductor, the parasitic capacitors $C_{p1}$ and $C_{p2}$ that are attached to the gate electrode of the driving transistor 22 decrease the bootstrap gain G. FIG. 18 illustrates an equivalent circuit of the parasitic capacitors attached to the gate electrode of the driving transistor 22 in the case of the multi-layer wiring structure.

As described above, if the difference ($=\Delta V_{th}$) exists in the threshold voltage $V_{th}$ of the driving transistor 22, the difference ($G\times\Delta V_{th}$) of the gate-source voltage $V_{gs}$ of the driving transistor 22 when the light emits may become smaller than $\Delta V_{th}$ and $\Delta V_{th}$ may not be perfectly reflected. As a result, the brightness irregularity or the roughness may occur in the display image.

The decrease in the bootstrap gain G is generated equally in the case in which the driving transistor 22 is formed over the insulator formed over the semiconductor such as the metal as well as the case in which the driving transistor 22 is formed over the semiconductor. This is because, when the TFT having the bottom gate structure is formed over the conductor substrate with the insulator therebetween, the TFT does not become a four-terminal element, but an entire portion between the conductor substrate and the gate electrode may become a parasitic capacitor, as described above.

<3. Embodiment>

An organic EL display device according to an embodiment of the present disclosure is configured to resolve a problem occurring when the driving transistor 22 is formed over the semiconductor such as the silicon or the insulator formed over the conductor substrate. This problem is a (problem occurring due to the effect of the substrate potential and the bootstrap gain G when the driving transistor 22 is formed over the semiconductor or a problem occurring due to a decrease in the bootstrap gain G when the driving transistor 22 is formed over the insulator formed over the conductor substrate, as described above.

In order to resolve the above problem, in this embodiment, the following configuration is adopted in a multi-layer wiring structure configured by stacking the gate electrode 221 and the source/drain electrode 222 of the driving transistor 22, that is, a multi-layer wiring structure configured by arranging a source/drain metal layer over a gate metal layer.

Figure 19:
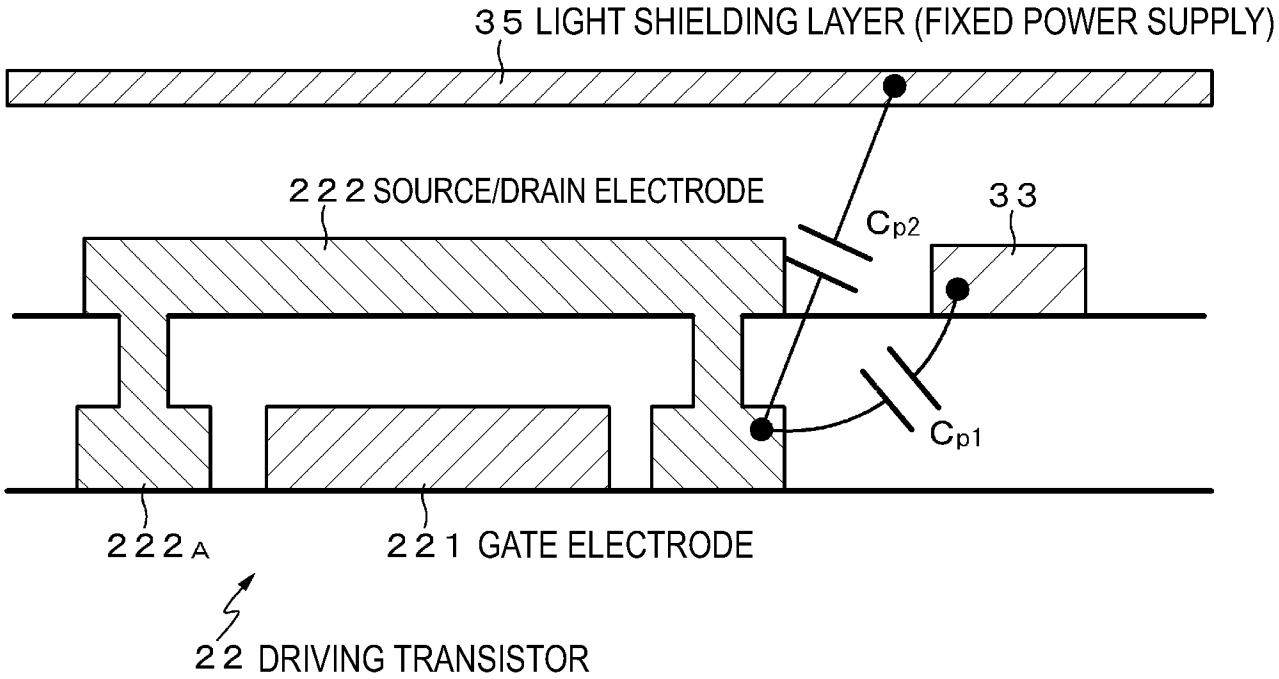
FIG. 19 is a cross-sectional view illustrating an example of a multi-layer wiring structure according to an embodiment of the present disclosure.

That is, as illustrated in FIG. 19, in this embodiment, a structure in which a peripheral portion of the gate electrode 221 is three-dimensionally covered by the source/drain electrode 222 is adopted. Specifically, a tubular portion $\mathbf{222}_A$ protruding to the side of the gate electrode 221 is formed in the source/drain electrode 222 and the peripheral portion of the gate electrode 221 is covered by the tubular portion $\mathbf{222}_A$ and the source/drain electrode 222.

In this case, the source/drain electrode 222 is one source/drain electrode of the driving transistor 22. In the multi-layer wiring structure, a channel formation layer or the other source/drain electrode of the driving transistor 22 is formed in a layer (other layer) different from the gate electrode 221 or one source/drain electrode 222.

Figure 20:
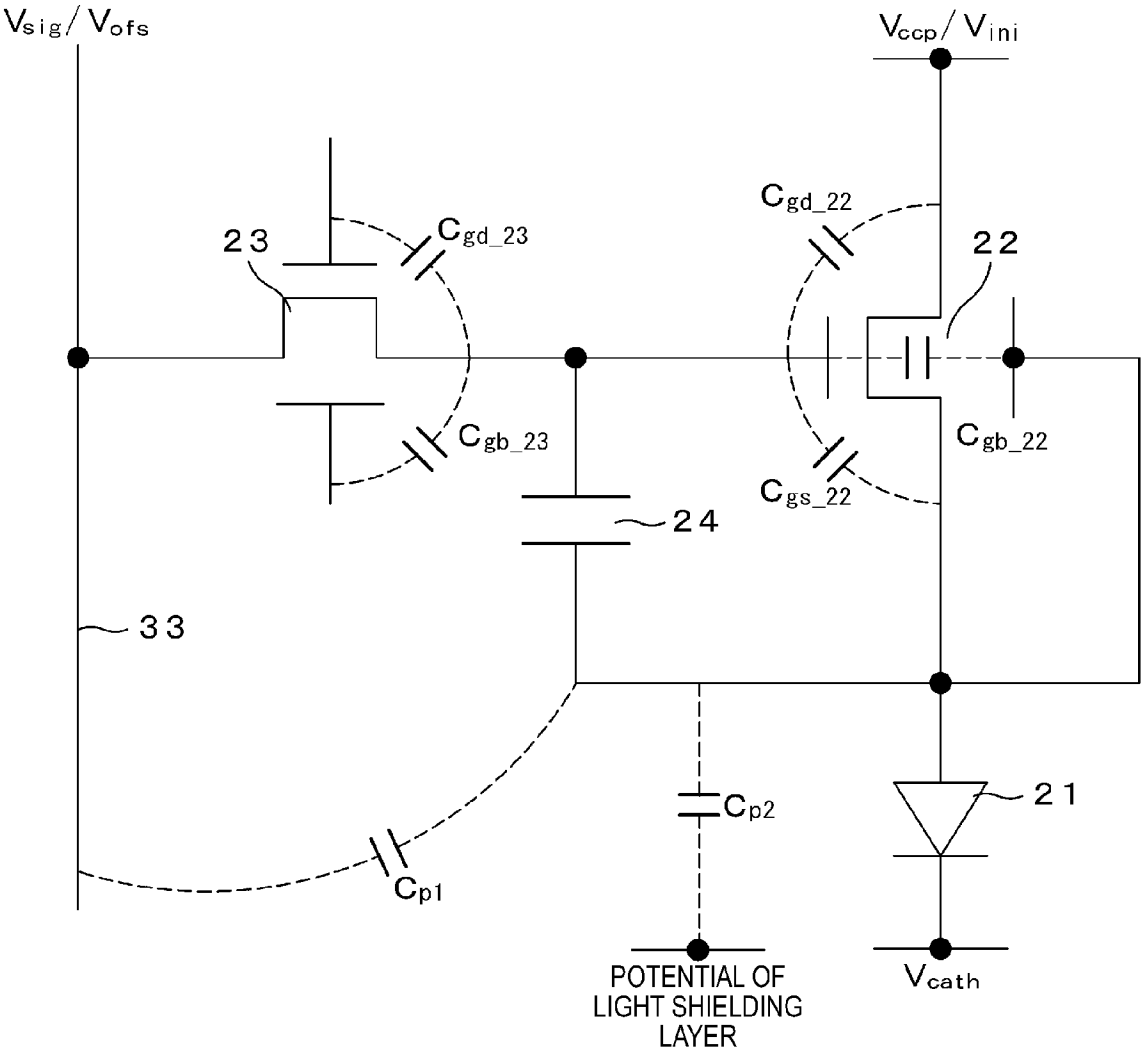
FIG. 20 is an equivalent circuit diagram of parasitic capacitors in the case of a multi-layer wiring structure according to an embodiment of the present disclosure.

As described above, in the multi-layer wiring structure, by adopting the structure in which the peripheral portion of the gate electrode 221 is three-dimensionally covered by the source/drain electrode 222, the parasitic capacitor is not generated between the gate electrode 221 of the driving transistor 22 and the metal of other layer, for example, the signal line 33 or the light shielding layer 35. Instead, as illustrated in FIG. 20, the parasitic capacitors $C_{p1}$ and $C_{p2}$ are generated between the source/drain electrode 222 of the driving transistor 22 and the metal of other layer, for example, the signal line 33 or the light shielding layer 35.

As described above, the bootstrap gain G is determined by the capacity value of the retention capacitor 24 and the capacity values of the parasitic capacitors attached to the gate electrode of the driving transistor 22. In the multi-layer wiring structure, the parasitic capacitor is not generated between the gate electrode of the driving transistor 22 and the metal of other layer, so that the capacity values of the parasitic capacitors attached to the gate electrode decrease, as compared with the case in which the gate electrode 221 is not three-dimensionally covered. Therefore, the bootstrap gain G can be increased.

By increasing the bootstrap gain G, the difference $\Delta V_{th}$ of the threshold voltage $V_{th}$ when the difference ($=\Delta V_{th}$) exists in the threshold voltage $V_{th}$ of the driving transistor 22 between the pixels can be reflected in the gate potential $V_g$ and the source potential $V_s$ of the driving transistor 22 during the bootstrap period after the threshold value correction operation. Thereby, finally, the gate-source voltage $V_{gs}$ of the driving transistor 22 when the light emits after the signal write ends may not be affected by the difference $\Delta V_{th}$ of the threshold voltage $V_{th}$. Therefore, uniform image quality in which there is no brightness irregularity or roughness can be obtained.

The parasitic capacitors $C_{p1}$ and $C_{p2}$ are generated between the source/drain electrode 222 of the driving transistor 22 and the signal line 33 or the light shielding layer 35, so that the gate-source capacity value of the driving transistor 22 can be increased. The gate-source capacity value of the driving transistor 22 increases, so that the change amount $\Delta V_s$ of the source potential $V_s$ of the driving transistor 22 in the mobility correction operation is moderated. Therefore, an image quality defect such as shading occurring due to the difference of the signal write time between the pixels can be decreased.

<4. Modification>

It should be understood by those skilled in the art that various modifications, combinations, sub-combinations and alterations may occur depending on design requirements and other factors insofar as they are within the scope of the appended claims or the equivalents thereof. That is, in the embodiment, in the multi-layer wiring structure, the channel formation layer of the driving transistor 22 is formed in the layer (other layer) different from the gate electrode 221 or one source/drain electrode 222. However, the present disclosure is not limited thereto.

For example, a structure in which the channel formation layer of the driving transistor 22 is arranged in the same layer as a gate metal layer (layer in which the gate electrode 221 is formed) or a region in which a peripheral region is covered by a source/drain metal layer (layer in which one source/drain electrode 222 is formed) can be adopted.

By adopting this structure, the channel formation layer of the driving transistor 22 can be shielded from the light by the source/drain metal layer. Therefore, because the light shielding layer 35 (refer to FIG. 19) to shield the channel formation layer from the light can be removed, a manufacturing cost can be decreased.

<5. Electronic Apparatus>

The display device according to an embodiment of the present disclosure described above can be used as a display unit (display device) in each of electronic apparatuses of all fields that display a video signal input to the electronic apparatuses or a video signal generated in the electronic apparatuses as an image or video.

As apparent from the explanation of the embodiment, because the display device according to an embodiment of the present disclosure can increase the bootstrap gain, the image quality defect such as the brightness irregularity or the roughness can be decreased. Therefore, in the electronic apparatuses of all fields, high-quality image display can be realized by using the display device according to an embodiment of the present disclosure as the display unit.

As the electronic apparatuses that use the display device according to an embodiment of the present disclosure as the display unit, a digital camera, a video camera, a game machine, and a notebook computer can be exemplified, in particular, the display device according to an embodiment of the present disclosure is suitable for a display unit in each of electronic apparatuses, such as a portable information apparatus such as an electronic book reader or an electronic wristwatch or a portable communication apparatus such as a mobile phone or a personal digital assistant (PDA).

<6. Configuration of Present Disclosure>

Additionally, the present disclosure may also be configured as below.

(1) A display device including:

pixel circuits which are arranged and each of which includes a driving transistor to drive an electro-optical element and a capacitor connected between a gate electrode and one source/drain electrode of the driving transistor, wherein the driving transistor is configured by stacking the gate electrode and the source/drain electrode and a peripheral portion of the gate electrode is covered by the source/drain electrode.

(2) The display device according to (1), wherein a peripheral portion of a channel formation layer of the driving transistor is covered by the source/drain electrode.

(3) The display device according to (1) or (2), wherein the driving transistor is formed over a semiconductor.

(4) The display device according to (1) or (2), wherein the driving transistor is formed over an insulator formed over a conductor.

(5) The display device according to any one of (1) to (4), wherein the pixel circuit flows a current to the driving transistor and performs writing of a video signal and mobility correction of the driving transistor.

(6) The display device according to (5), wherein the pixel circuit applies negative feedback to a gate-source potential difference of the driving transistor with a correction amount according to the current flowing to the driving transistor and performs the mobility correction of the driving transistor.

(7) An electronic apparatus including:

a display device including pixel circuits which are arranged and each of which includes a driving transistor to drive an electro-optical element, wherein the driving transistor is configured by stacking a gate electrode and a source/drain electrode and a peripheral portion of the gate electrode is covered by the source/drain electrode.

The present disclosure contains subject matter related to that disclosed in Japanese Priority Patent Application JP 2012-191640 filed in the Japan Patent Office on Aug. 31, 2012, the entire content of which is hereby incorporated by reference.

What is claimed is:

1. A display device comprising:

pixel circuits which are arranged over a substrate and each pixel circuit includes a driving transistor to drive an electro-optical element and a capacitor connected between a gate electrode and a source electrode of the driving transistor, wherein the driving transistor is configured by stacking the gate electrode and the source electrode over the substrate and a peripheral portion of the gate electrode is three-dimensionally covered by the source electrode such that the source electrode extends above the gate electrode and a tubular portion of the source electrode covers each of the sides of the gate electrode on the substrate, wherein a parasitic capacitance is not generated between the gate electrode of the driving transistor and a signal line, and wherein each of the pixel circuits is configured to perform a mobility correction of the driving transistor by applying a negative feedback to a gate-source potential difference of the driving transistor with a correction amount according to a current flowing to the driving transistor during a writing operation of a video signal.

2. The display device according to claim 1, wherein a peripheral portion of a channel formation layer of the driving transistor is covered by the source electrode.

3. The display device according to claim 1, wherein the driving transistor is formed over a semiconductor.

4. The display device according to claim 1, wherein the driving transistor is formed over an insulator formed over a conductor.

5. The display device according to claim 1, wherein the pixel circuit flows the current to the driving transistor and performs writing of the video signal and the mobility correction of the driving transistor.

6. An electronic apparatus comprising:

a display device including pixel circuits which are arranged over a substrate and each pixel circuit includes a driving transistor to drive an electro-optical element, and a capacitor connected between a gate electrode and a source electrode of the driving transistor, wherein the driving transistor is configured by stacking a gate electrode and the source electrode over the substrate and a peripheral portion of the gate electrode is three-dimensionally covered by the source electrode such that the source electrode extends above the gate electrode and a tubular portion of the source electrode covers each of the sides of the gate electrode on the substrate, wherein a parasitic capacitance is not generated between the gate electrode of the driving transistor and a signal line, and wherein each of the pixel circuits is configured to perform a mobility correction of the driving transistor by applying a negative feedback to a gate-source potential difference of the driving transistor with a correction amount according to a current flowing to the driving transistor during a writing operation of a video signal.

7. The electronic apparatus according to claim 6, wherein a peripheral portion of a channel formation layer of the driving transistor is covered by the source electrode.

8. The electronic apparatus according to claim 6, wherein the driving transistor is formed over a semiconductor.

9. The electronic apparatus according to claim 6, wherein the driving transistor is formed over an insulator formed over a conductor.

10. The electronic apparatus according to claim 6, wherein the pixel circuit flows the current to the driving transistor and performs writing of the video signal and the mobility correction of the driving transistor.

11. A display device comprising:

pixel circuits which are arranged over a substrate and each pixel circuit includes a driving transistor to drive an electro-optical element and a capacitor connected between a gate electrode and a source electrode of the driving transistor, wherein the driving transistor is configured by stacking the gate electrode and a drain electrode over the substrate and a peripheral portion of the gate electrode is three-dimensionally covered by the drain electrode such that the drain electrode extends above the gate electrode and a tubular portion of the drain electrode covers each of the sides of the gate electrode on the substrate, wherein a parasitic capacitance is not generated between the gate electrode of the driving transistor and a signal line, and wherein each of the pixel circuits is configured to perform a mobility correction of the driving transistor by applying a negative feedback to a gate-source potential difference of the driving transistor with a correction amount according to a current flowing to the driving transistor during a writing operation of a video signal.

12. The display device according to claim 11, wherein a peripheral portion of a channel formation layer of the driving transistor is covered by the drain electrode.

13. The display device according to claim 11, wherein the driving transistor is formed over a semiconductor.

14. The display device according to claim 11, wherein the driving transistor is formed over an insulator formed over a conductor.

15. The display device according to claim 11, wherein the pixel circuit flows the current to the driving transistor and performs writing of the video signal and the mobility correction of the driving transistor.

16. An electronic apparatus comprising:

a display device including pixel circuits which are arranged over a substrate and each pixel circuit includes a driving transistor to drive an electro-optical element, and a capacitor connected between a gate electrode and a source electrode of the driving transistor, wherein the driving transistor is configured by stacking a gate electrode and a drain electrode over the substrate and a peripheral portion of the gate electrode is three-dimensionally covered by the drain electrode such that the drain electrode extends above the gate electrode and a tubular portion of the drain electrode covers each of the sides of the gate electrode on the substrate, wherein a parasitic capacitance is not generated between the gate electrode of the driving transistor and a signal line, and wherein each of the pixel circuits is configured to perform a mobility correction of the driving transistor by applying a negative feedback to a gate-source potential difference of the driving transistor with a correction amount according to a current flowing to the driving transistor during a writing operation of a video signal.

17. The electronic apparatus according to claim 16, wherein a peripheral portion of a channel formation layer of the driving transistor is covered by the drain electrode.

18. The electronic apparatus according to claim 16, wherein the driving transistor is formed over a semiconductor.

19. The electronic apparatus according to claim 16, wherein the driving transistor is formed over an insulator formed over a conductor.

20. The electronic apparatus according to claim 16, wherein the pixel circuit flows the current to the driving transistor and performs writing of the video signal and the mobility correction of the driving transistor.

* * * * *